US012635726B2

(12) United States Patent
Holford

(10) Patent No.: US 12,635,726 B2
(45) Date of Patent: May 26, 2026

(54) COMPONENT FOR AN ARTICLE FOR USE IN A NON-COMBUSTIBLE AEROSOL PROVISION SYSTEM

(71) Applicant: Nicoventures Trading Limited, London (GB)

(72) Inventor: Steven Holford, London (GB)

(73) Assignee: Nicoventures Trading Limited, London (GB)

( * ) Notice: Subject to any disclaimer, the term of this patent is extended or adjusted under 35 U.S.C. 154(b) by 415 days.

(21) Appl. No.: 17/785,948

(22) PCT Filed: Dec. 18, 2020

(86) PCT No.: PCT/GB2020/053302
§ 371 (c)(1),
(2) Date: Jun. 16, 2022

(87) PCT Pub. No.: WO2021/123820
PCT Pub. Date: Jun. 24, 2021

(65) Prior Publication Data

US 2023/0023810 A1 Jan. 26, 2023

(30) Foreign Application Priority Data

Dec. 20, 2019 (GB) ..... 1918991

(51) Int. Cl.
*A24D 1/20* (2020.01)
*A24D 1/02* (2006.01)
(Continued)

(52) U.S. Cl.
CPC ..... *A24D 1/20* (2020.01); *A24D 1/027* (2013.01); *A24D 3/043* (2013.01); *A24D 3/063* (2013.01)

(58) Field of Classification Search
CPC ..... A24D 1/20; A24D 1/027; A24D 3/043; A24D 3/063
(Continued)

(56) References Cited

U.S. PATENT DOCUMENTS 5,666,978 A 9/1997 Counts et al.
2018/0116275 A1 5/2018 Malgat et al.
2018/0199618 A1* 7/2018 Fuisz ..... A24B 15/32

FOREIGN PATENT DOCUMENTS

CA 2442616 A1 10/2002
CA 3063952 A1 12/2019
(Continued)

OTHER PUBLICATIONS

International Search Report and Written Opinion for Application No. PCT/GB2020/053302, mailed on Jun. 2, 2021, 23 pages.
(Continued)

*Primary Examiner* — Gary F Paumen
(74) *Attorney, Agent, or Firm* — MERCHANT & GOULD P.C.

(57) ABSTRACT

A component, system and related methods of manufacture for an article for use in a non-combustible aerosol provision system includes a mouth end section, a first tubular section defining a first cavity upstream of the mouth end section, a second tubular section defining a second cavity upstream of the first tubular section and a body disposed between the first tubular section and the second tubular section.

19 Claims, 9 Drawing Sheets

(51) Int. Cl.
*A24D 3/04* (2006.01)
*A24D 3/06* (2006.01)

(58) Field of Classification Search
USPC ..... 131/328
See application file for complete search history.

(56) References Cited

FOREIGN PATENT DOCUMENTS

| | | | | | |
|---|---|---|---|---|---|
| EP | 2510814 | A1 | | 10/2012 | |
| EP | 3178333 | A1 | | 6/2017 | |
| EP | 3494809 | A1 | | 6/2019 | |
| JP | H11507234 | A | * | 6/1999 | ..... A24F 47/00 |
| JP | 2010521143 | A | | 6/2010 | |
| JP | 2017516472 | A | | 6/2017 | |
| JP | 2018511316 | A | | 4/2018 | |
| JP | 2020000261 | A | * | 1/2020 | ..... A24D 3/0216 |
| RU | 2665444 | C1 | | 8/2018 | |
| WO | 2014023555 | A1 | | 2/2014 | |
| WO | 2016021021 | A1 | | 2/2016 | |
| WO | 2019105950 | A1 | | 6/2019 | |
| WO | 2019166640 | A1 | | 9/2019 | |
| WO | WO-2020249954 | A1 | | 12/2020 | |

OTHER PUBLICATIONS

"International Preliminary Report on Patentability received for PCT Patent Application No. PCT/GB2020/053302, mailed on Jun. 30, 2022", 14 pages.

"Invitation to Pay Additional Fees received for PCT Patent Application No. PCT/GB2020/053302, mailed on Apr. 12, 2021", 14 pages.

"Notice of Reasons for Rejection received for Japanese Patent Application No. 2022-537586, mailed on Aug. 29, 2023", 11 pages (6 pages of English Translation and 5 pages of Official copy).

"Office Action received for Japanese Patent Application No. 2022-537586, mailed on Jul. 2, 2024", 5 pages (2 pages of English Translation and 3 pages of Official Copy).

"Office Action received for Russian Patent Application No. 2022119693, mailed on Apr. 23, 2024", 21 pages (10 pages of English Translation and 11 pages of Official Copy).

* cited by examiner

COMPONENT FOR AN ARTICLE FOR USE IN A NON-COMBUSTIBLE AEROSOL PROVISION SYSTEM

PRIORITY CLAIM

The present application is a National Phase entry of PCT Application No. PCT/GB2020/053302, filed Dec. 18, 2020, which claims priority from GB Application No. 1918991.9, filed Dec. 20, 2019, each of which is hereby fully incorporated herein by reference.

TECHNICAL FIELD

The following relates to a component for an article for use in a non-combustible aerosol provision system, an article for use in a non-combustible aerosol provision system, a non-combustible aerosol provision system including an article, and a method of manufacturing an article for use in a non-combustible aerosol provision system.

BACKGROUND

Certain tobacco industry products produce an aerosol during use, which is inhaled by a user. For example, tobacco heating devices heat an aerosol generating substrate such as tobacco to form an aerosol by heating, but not burning, the substrate. Such tobacco industry products commonly include mouthpieces through which the aerosol passes to reach the user's mouth.

SUMMARY

In accordance with embodiments of the invention, in a first aspect there is provided a component for an article for use in a non-combustible aerosol provision system, the component comprising:

- a mouth end section;
- a first tubular section defining a first cavity upstream of the mouth end section;
- a second tubular section defining a second cavity upstream of the first tubular section; and
- a body disposed between the first tubular section and the second tubular section.

In accordance with embodiments of the invention, in a second aspect there is provided an article for use with a non-combustible aerosol provision device, the article comprising:

- an aerosol generating material comprising at least one aerosol forming material; and
- a component according to the first aspect set out above and/or described herein.

In accordance with embodiments of the invention, in a third aspect there is provided a non-combustible aerosol provision system, comprising:

- an article according to the first aspect set out above and/or described herein; and
- a non-combustible aerosol provision device for use with the article.

In accordance with embodiments of the invention, in a fourth aspect there is provided a method of manufacturing a component for an article for use in a non-combustible aerosol provision system, the method comprising:

- providing a mouth end section, a first tubular section, a second tubular section and a body; and
- arranging the mouth end section, the first tubular section, the second tubular section and the body so that the first tubular section defines a first cavity upstream of the mouth end section, the second tubular section defines a second cavity upstream of the first tubular section and the body is disposed between the first tubular section and the second tubular section.

BRIEF DESCRIPTION OF THE DRAWINGS

Embodiments of the invention will now be described, by way of example only, with reference to the accompanying drawings, in which.

DETAILED DESCRIPTION OF THE DRAWINGS

Figure 1:
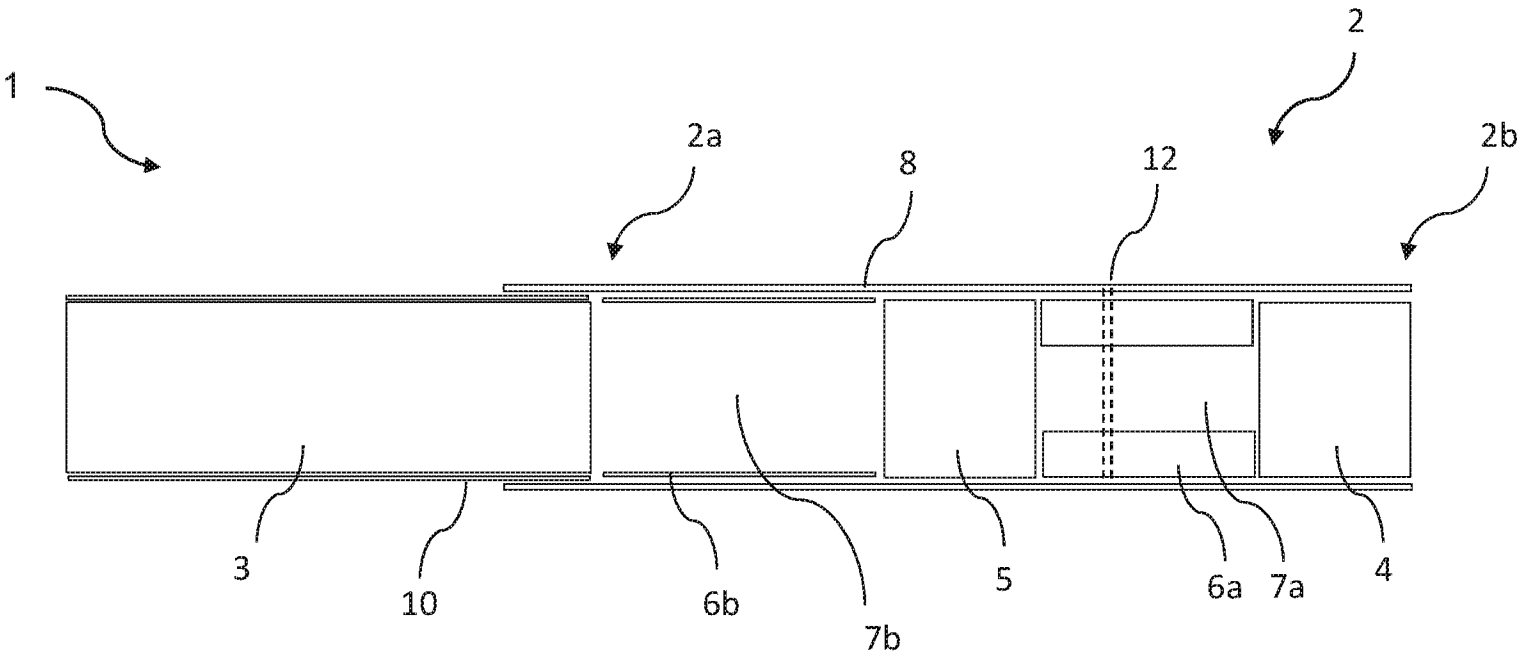
FIG. 1 is a side-on cross sectional view of an article for use as part of a non-combustible aerosol provision system, the article including a component having a first continuous body at the mouth end and a second continuous body disposed between a first tubular section and a second tubular section.

As used herein, the term "delivery system" is intended to encompass systems that deliver at least one substance to a user, and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; and
- aerosol-free delivery systems that deliver the at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

According to the present disclosure, a "combustible" aerosol provision system is one where a constituent aerosol-generating material of the aerosol provision system (or component thereof) is combusted or burned during use in order to facilitate delivery of at least one substance to a user.

In some embodiments, the delivery system is a combustible aerosol provision system, such as a system selected from the group consisting of a cigarette, a cigarillo and a cigar.

In some embodiments, the disclosure relates to a component for use in a combustible aerosol provision system, such as a filter, a filter rod, a filter segment, a tobacco rod, a spill, an aerosol-modifying agent release component such as a capsule, a thread, or a bead, or a paper such as a plug wrap, a tipping paper or a cigarette paper.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine. In some embodiments, the active substance comprises caffeine, melatonin or vitamin B12.

Aerosol-generating material is a material that is capable of generating aerosol, for example when heated, irradiated or energized in any other way. Aerosol-generating material may, for example, be in the form of a solid, liquid or gel which may or may not contain an active substance and/or flavorants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

The aerosol-generating material may comprise one or more active substances and/or flavors, one or more aerosol-former materials, and optionally one or more other functional material.

The aerosol-former material may comprise one or more constituents capable of forming an aerosol. In some embodiments, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional materials may comprise one or more of pH regulators, coloring agents, preservatives, binders, fillers, stabilizers, and/or antioxidants.

The materials described herein may be present on or in a support, to form a substrate. The support may, for example, be or comprise paper, card, paperboard, cardboard, reconstituted material, a plastics material, a ceramic material, a composite material, glass, a metal, or a metal alloy. In some embodiments, the support comprises a susceptor. In some embodiments, the susceptor is embedded within the material. In some alternative embodiments, the susceptor is on one or either side of the material.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

An aerosol-modifying agent is a substance, typically located downstream of the aerosol generation area, that is configured to modify the aerosol generated, for example by changing the taste, flavor, acidity or another characteristic of the aerosol. The aerosol-modifying agent may be provided in an aerosol-modifying agent release component, that is operable to selectively release the aerosol-modifying agent The aerosol-modifying agent may, for example, be an additive or a sorbent. The aerosol-modifying agent may, for example, comprise one or more of a flavourant, a colourant, water, and a carbon adsorbent. The aerosol-modifying agent may, for example, be a solid, a liquid, or a gel. The aerosol-modifying agent may be in powder, thread or granule form. The aerosol-modifying agent may be free from filtration material.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

In one embodiment, the susceptor is in the form of a closed circuit. It has been found that, when the susceptor is in the form of a closed circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

Articles, such as consumables described herein, for instance those in the shape of rods, are often named according to the product length: "regular" (typically in the range 68-75 mm, e.g. from about 68 mm to about 72 mm), "short" or "mini" (68 mm or less), "king size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the product circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm).

Accordingly, an article in a king-size, super-slim format will, for example, have a length of about 83 mm and a circumference of about 17 mm.

Articles may include an aerosol-generating material and a downstream portion downstream of the aerosol-generating material, and each format may be produced with downstream portions of different lengths. The downstream portion length will usually be from about 30 mm to 50 mm. A tipping paper connects the downstream portion to the aerosol generating material and will usually have a greater length than the downstream portion, for example from 3 to 10 mm longer, such that the tipping paper covers the downstream portion and overlaps the aerosol generating material, for instance in the form of a rod, to connect the downstream portion to the rod.

Articles and their aerosol generating materials and downstream portions described herein can be made in, but are not limited to, any of the above formats.

The terms 'upstream' and 'downstream' used herein are relative terms defined in relation to the direction of mainstream aerosol drawn though an article or device in use.

The filamentary tow or filter material described herein can comprise cellulose acetate fiber tow. The filamentary tow can also be formed using other materials used to form fibers, such as polyvinyl alcohol (PVOH), polylactic acid (PLA), polycaprolactone (PCL), poly(1-4 butanediol succinate) (PBS), poly(butylene adipate-co-terephthalate)(PBAT), starch based materials, cotton, aliphatic polyester materials and polysaccharide polymers or a combination thereof. The filamentary tow may be plasticized with a suitable plasticizer for the tow, such as triacetin where the material is cellulose acetate tow, or the tow may be non-plasticized. The tow can have any suitable specification, such as fibers having a 'Y' shaped or other cross section such as 'X' shaped, filamentary denier values between 2.5 and 15 denier per filament, for example between 8.0 and 11.0 denier per filament and total denier values of 5,000 to 50,000, for example between 10,000 and 40,000. The cross section of the fibers may have an isoperimetric ratio $L^2/A$ of 25 or less, preferably 20 or less, and more preferably 15 or less, where L is the length of the perimeter of the cross section and A is the area of the cross section. Such fibers have a relatively low surface area for a given value of denier per filament, which improves delivery of aerosol to the consumer. Filter material described herein also includes cellulose-based materials such as paper. Such materials may have a relatively low density, such as between about 0.1 and about 0.45 grams per cubic centimeter, to allow air and/or aerosol to pass through the material. Although described as filter materials, such materials may have a primary purpose, such as increasing the resistance to draw of a component, that is not related to filtration as such.

As used herein, the term "tobacco material" refers to any material comprising tobacco or derivatives or substitutes thereof. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, tobacco lamina, reconstituted tobacco and/or tobacco extract.

As noted herein, the active substance, which can for instance be used as an aerosol modifying agent, may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha Arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from eucalyptus, star anise, cocoa and hemp.

In some embodiments, the active substance comprises or derived from one or more botanicals or constituents, derivatives or extracts thereof and the botanical is selected from rooibos and fennel.

In some embodiments, the substance to be delivered comprises a flavor.

As used herein, the terms "flavor" and "flavorant" refer to materials which, where local regulations permit, may be used, for instance as an aerosol modifying agent, to create a desired taste, aroma or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

In the figures described herein, like reference numerals are used to illustrate equivalent features, articles or components.

FIG. 1 is a side-on cross sectional view of an article 1 for use with a non-combustible aerosol provision system. In the present example, and other examples described herein, the article can be a tobacco heated product consumable.

The article 1 comprises a component 2, in the present example a mouthpiece 2 to be received in a user's mouth, and a cylindrical rod of aerosol generating material 3, in the present case tobacco material, connected to the component 2. The component 2 includes a first continuous body 4 at the mouth end and a second continuous body 5 disposed between a first tubular section 6*a* and a second tubular section 6*b*. The aerosol generating material 3 provides an aerosol when heated, for instance within a non-combustible aerosol provision device as described herein, for instance a non-combustible aerosol provision device comprising a coil, forming a system. In other embodiments, the article 1 can include its own heat source, forming an aerosol provision system without requiring a separate aerosol provision device. In alternative examples, the component 2 may comprise a portion of the article 1 downstream of the aerosol generating material 3, which is not arranged to be received in a user's mouth.

The aerosol generating material 3, also referred to herein as an aerosol generating substrate 3, comprises at least one aerosol forming material. In the present example, the aerosol forming material is glycerol. In alternative examples, the aerosol forming material can be another material as described herein or a combination thereof. The aerosol forming material has been found to improve the sensory performance of the article, by helping to transfer compounds such as flavor compounds from the aerosol generating material to the consumer. However, an issue with adding such aerosol forming materials to the aerosol generating material within an article for use in a non-combustible aerosol provision system can be that, when the aerosol forming material is aerosolized upon heating, it can increase the mass of aerosol which is delivered by the article, and this increased mass can maintain a higher temperature as it passes through the mouthpiece. As it passes through the mouthpiece, the aerosol transfers heat into the mouthpiece and this warms the outer surface of the mouthpiece, including the area, which comes into contact with the consumers lips during use. The mouthpiece temperature and/or aerosol temperature can be significantly higher than consumers may be accustomed to when smoking, for instance, conventional cigarettes, and this can be an undesirable effect caused by the use of such aerosol forming materials.

The first and second tubular sections 6*a*, 6*b*, are also referred to as cooling sections, and define respective first and second cavities 7*a*, 7*b*. While it has been known to use a single cavity formed by a tubular section to cool aerosol, it has surprisingly been found that first and second tubular sections defining first and second cavities upstream of a first body 4, have a particularly enhanced cooling effect.

In the present example, the first tubular section 6*a* is formed from filamentary tow and has a wall thickness of at least about 0.5 mm, for instance about 0.5 mm to about 3 mm, or about 0.5 mm to about 2.5 mm. The use of filamentary tow and/or wall thicknesses in these ranges have advantage of insulating the hot aerosol passing through the first cavity 6*a* from the outer surface of the first tubular section 6*a*.

The first body of material 4 and second body of material 5 are each wrapped in respective first and second plug wraps (not shown). The first and second bodies of material 4, 5 and first and second tubular sections 6*a*, 6*b* can be combined using a third plug wrap (not shown) which is wrapped around each of these parts. A tipping paper 8 is wrapped around the full length of the component 2 and over part of the rod of aerosol generating material 3 and has an adhesive on its inner surface to connect the component 2 and rod 3.

In the present example, the second tubular section 6*b* is formed from a plurality of layers of paper, which are parallel wound, with butted seams, to form a hollow tube. In the present example, first and second paper layers are provided in a two-ply tube, although in other examples 3, 4 or more paper layers can be used forming 3, 4 or more ply tubes. Other constructions can be used, such as spirally wound layers of paper, cardboard tubes, tubes formed using a papier-mâché type process, molded or extruded plastic tubes or similar.

The second tubular section 6*b* can also be formed using a stiff plug wrap and/or tipping paper as the third plug wrap and/or tipping paper 8 described herein, meaning that a separate tubular element is not required. The stiff plug wrap and/or tipping paper is manufactured to have a rigidity that is sufficient to withstand the axial compressive forces and bending moments that might arise during manufacture and whilst the article 1 is in use. For instance, the stiff plug wrap and/or tipping paper can have a basis weight between 70 gsm and 120 gsm, more preferably between 80 gsm and 110 gsm. Additionally or alternatively, the stiff plug wrap and/or tipping paper can have a thickness between 80 μm and 200 μm, more preferably between 100 μm and 160 μm, or from 120 μm to 150 μm. It can be desirable for both the plug wrap and tipping paper 8 to have values in these ranges, to achieve an acceptable overall level of rigidity for the second tubular section 6*b*.

The second tubular section 6*b* preferably has a wall thickness of at least about 100 μm and up to about 1.5 mm, preferably between 100 μm and 1 mm and more preferably between 150 μm and 500 μm, or about 300 μm. In the present example, the second tubular section 6*b* has a wall thickness of about 290 μm. The "wall thickness" of the second tubular section 6*b* corresponds to the thickness of the wall of the second tubular section 6*b* in a radial direction. This may be measured, for example, using a caliper.

In some embodiments, the second tubular section 6*b* has a wall thickness of at least about 325 μm and up to about 2 mm, preferably between 500 μm and 1.5 mm and more preferably between 750 μm and 1 mm. In some embodiments, the thickness of the wall of the second tubular section 6*b* is at least 325 microns and, preferably, at least 400, 500, 600, 700, 800, 900 or 1000 microns. In some embodiments, the thickness of the wall of the second tubular section 6*b* is at least 1250 or 1500 microns.

In some embodiments, the thickness of the wall of the second tubular section 6*b* is less than 2000 microns and, preferably, less than 1500 microns.

The increased thickness of the wall of the second tubular section 6*b* means that it has a greater thermal mass, which has been found to help reduce the temperature of the aerosol passing through the second tubular section 6*b* and reduce the surface temperature of the mouthpiece at locations downstream of the second tubular section 6*b*. This is thought to be because the greater thermal mass of the second tubular section 6*b* allows the second tubular section 6*b* to absorb more heat from the aerosol in comparison to a second tubular section 6*b* with a thinner wall thickness. The increased thickness of the second tubular section 6*b* also channels the aerosol centrally within the mouthpiece such that less heat from the aerosol is transferred to the outer portions of the mouthpiece such as outer portions of the body of material.

In some embodiments, the permeability of the second tubular section 6*b* is at least 100 Coresta Units and, preferably, at least 150 or 200 Coresta Units.

It has been found that the relatively high permeability of the second tubular section 6*b* increases the amount of heat that is transferred to the second tubular section 6*b* from the aerosol and thus reduces the temperature of the aerosol. The permeability of the second tubular section 6*b* has also been found to increase the amount of moisture that is transferred from the aerosol to the second tubular section 6*b*, which has been found to improve the feel of the aerosol in the user's mouth. A high permeability of second tubular section 6*b* also makes it easier to cut the ventilation holes using a laser, meaning that a lower power of laser can be used In some examples, the aerosol generating material described herein is a first aerosol generating material and the second body of material 5', the first tubular section 6*a*, 6*a*', 6*a*" and/or the second tubular section 6*b* may include a second aerosol generating material. The second aerosol generating material can be the same as the aerosol generating materials described herein. The second body of material 5', the first tubular section 6*a*,6*a*', 6*a*" and/or the second tubular section 6*b* can comprise a wall, which comprises the second aerosol generating material. For example, the second aerosol generating material can be disposed on the inner wall of the second body of material 5', the first tubular section 6*a*, 6*a*', 6*a*" and/or the second tubular section 6*b*. Alternatively or in addition, the second body of material 5', the first tubular section 6*a*, 6*a*', 6*a*" and/or the second tubular section 6*b* may include an active substance as defined herein, such as a flavor or flavorant. The active substance can, for instance, be sprayed onto the second body of material 5', the first tubular section 6*a*, 6*a*', 6*a*" and/or the second tubular section 6*b* in liquid form. The second body of material 5', the first tubular section 6*a*,6*a*', 6*a*" and/or the second tubular section 6*b* can comprise a wall, which comprises the active substance. For example, the active substance can be disposed on the inner wall of the second body of material 5', the first tubular section 6*a*, 6*a*', 6*a*" and/or the second tubular section 6*b*. There can be particular advantages with including a second aerosol generating material or an active substance on the second body of material 5' and the second tubular section 6*b*, since these reach higher temperatures in use than components further downstream and therefore the release of aerosol or active substances from the second body of material 5' and the second tubular section 6*b* can be enhanced.

The second aerosol generating material comprises at least one aerosol former material, and may also comprise at least one aerosol modifying agent, or other sensate material. The aerosol former material and/or aerosol-modifying agent can be any aerosol former material or aerosol modifying agent as described herein, or a combination thereof.

As the aerosol generated from aerosol generating material 3, referred to herein as the first aerosol, is drawn through the second tubular section 6*b* of the mouthpiece, heat from the first aerosol may aerosolize the aerosol forming material of the second aerosol generating material, to form a second aerosol. The second aerosol may comprise a flavorant, which may be additional or complementary to the flavor of the first aerosol.

Providing a second aerosol generating material on the second tubular section 6*b* can result in generation of a second aerosol, which boosts or complements the flavor or visual appearance of the first aerosol.

In the present example, the article 1 has an outer circumference of about 21 mm (i.e. the article is in the demi-slim format). Preferably, the article 1 has a rod of aerosol generating material having a circumference greater than 19 mm. This has been found to provide a sufficient circumference to generate an improved and sustained aerosol over a usual aerosol generation session preferred by consumers. As the article is heated, heat transfers through the rod of aerosol generating material 3 to volatize components of the rod, and circumferences greater than 19 mm have been found to be particularly effective at producing an aerosol in this way. Since the article is to be heated to release an aerosol, improved heating efficiency can be achieved using articles having circumferences of less than about 23 mm. To achieve improved aerosol via heating, while maintaining a suitable product length, rod circumferences of greater than 19 mm and less than 23 mm are preferable. In some examples, the rod circumference can be between 20 mm and 22 mm, which has been found to provide a good balance between providing effective aerosol delivery while allowing for efficient heating.

The outer circumference of the mouthpiece 2 is substantially the same as the outer circumference of the rod of aerosol generating material 3, such that there is a smooth transition between these components. In the present example, the outer circumference of the mouthpiece 2 is about 20.8 mm.

In some examples, the article 1 may be configured such that there is a separation (i.e. a minimum distance) between a heater of the non-combustible aerosol provision device 100 and the second tubular section 6*b*. This prevents heat from the heater from damaging the material forming the second tubular section 6*b*.

The minimum distance between a heater of the non-combustible aerosol provision device 100 and the second tubular section 6*b* may be 3 mm or greater. In some examples, minimum distance between the heater of the non-combustible aerosol provision device 100 and the second tubular section 6*b* may be in the range 3 mm to 10 mm, for example 3 mm, 4 mm, 5 mm, 6 mm, 7 mm, 8 mm, 9 mm or 10 mm.

The separation between the heating element of the non-combustible aerosol provision device 100 and the second tubular section 6*b* may be achieved by, for example, adjusting the length of the rod of aerosol generating material 3.

In the present example, the tipping paper 8 extends 5 mm over the rod of aerosol generating material 3 but it can alternatively extend between 3 mm and 10 mm over the rod 3, or more preferably between 4 mm and 6 mm, to provide a secure attachment between the mouthpiece 2 and rod 3. The tipping paper 8 can have a basis weight, which is higher than the basis weight of plug wraps used in the article 1, for instance a basis weight of 40 gsm to 80 gsm, more preferably between 50 gsm and 70 gsm, and in the present example 58 gsm. These ranges of basis weights have been found to result in tipping papers having acceptable tensile strength while being flexible enough to wrap around the article 1 and adhere to itself along a longitudinal lap seam on the paper.

The outer circumference of the tipping paper 8, once wrapped around the mouthpiece 2, is about 21 mm.

The first and/or second plug wraps can have a basis weight of less than 50 gsm, for instance between about 20 gsm and 40 gsm. The first and/or second plug wraps can have a thickness of between 30 μm and 60 μm, for instance between 35 μm and 45 μm. The first and/or second plug wraps can be non-porous plug wraps, for instance having a permeability of less than 100 Coresta units, for instance less than 50 Coresta units. However, in other embodiments, the first and/or second plug wraps can be a porous plug wrap, for instance having a permeability of greater than 200 Coresta Units.

Preferably, the length of the first and second bodies of material 4, 5 is less than about 20 mm. In the present example, the length of each of the first and second bodies of material 4, 5 is 6 mm.

In the present example, the first and second bodies of material 4, 5 are formed from filamentary tow. In the present example, the tow used in the first and second bodies of material 4, 5 has a denier per filament (d.p.f.) of 8.4 and a total denier of 21,000. Alternatively, the tow can, for instance, have a denier per filament (d.p.f.) of 9.5 and a total denier of 12,000. In the present example, the tow comprises plasticized cellulose acetate tow. The plasticizer used in the tow comprises about 7% by weight of the tow. In the present example, the plasticizer is triacetin. In other examples, different materials can be used to form the bodies of material 4, 5. For instance, rather than tow, the first and/or second body 4, 5 can be formed from paper, for instance in a similar way to paper filters known for use in cigarettes. Alternatively, the first and/or second bodies 4, 5 can be formed from tows other than cellulose acetate, for instance polylactic acid (PLA), other materials described herein for filamentary tow or similar materials. The tow is preferably formed from cellulose acetate. The tow, whether formed from cellulose acetate or other materials, preferably has a d.p.f. of at least 5, more preferably at least 6 and still more preferably at least 7. These values of denier per filament provide a tow which has relatively coarse, thick fibers with a lower surface area which result in a lower pressure drop across the mouthpiece 2 than tows having lower d.p.f. values. Preferably, to achieve a sufficiently uniform body of material 4, 5, the tow has a denier per filament of no more than 12 d.p.f., preferably no more than 11 d.p.f. and still more preferably no more than 10 d.p.f.

The total denier of the tow forming the first and second bodies of material 4, 5 is preferably at most 30,000, more preferably at most 28,000 and still more preferably at most 25,000. These values of total denier provide a tow which takes up a reduced proportion of the cross sectional area of the mouthpiece 2 which results in a lower pressure drop across the mouthpiece 2 than tows having higher total denier values. For appropriate firmness of the body of material 4, 5, the tow preferably has a total denier of at least 8,000 and more preferably at least 10,000. Preferably, the denier per filament is between 5 and 12 while the total denier is between 10,000 and 25,000. More preferably, the denier per filament is between 6 and 10 while the total denier is between 11,000 and 22,000. Preferably the cross-sectional shape of the filaments of tow are 'Y' shaped, although in other embodiments other shapes such as 'X' shaped filaments can be used, with the same d.p.f. and total denier values as provided herein.

The cross section of the fibers may have an isoperimetric ratio $L^2/A$ of 25 or less, 20 or less, or 15 or less, where L is the length of the perimeter of the cross section and A is the area of the cross section. Such fibers have a relatively low surface area for a given value of denier per filament, which improves delivery of aerosol to the consumer.

Preferably, the length of the first and second tubular sections 6*a*, 6*b* is less than about 50 mm. More preferably, the length of the first and second tubular sections 6*a*, 6*b* is less than about 40 mm. Still more preferably, the length of the first and second tubular sections 6*a*, 6*b* is less than about 30 mm. In addition, or as an alternative, the length of the first and second tubular sections 6*a*, 6*b* is preferably at least about 10 mm. Preferably, the length of the first and/or second tubular sections 6*a*, 6*b* is at least about 15 mm. In some preferred embodiments, the length of the second tubular section 6*b* is from about 20 mm to about 30 mm, or from about 22 mm to about 28 mm, or from about 24 to about 26 mm, for instance about 25 mm. In the present example, the length of the second tubular section 6*b* is 25 mm. In some preferred embodiments, the length of the first tubular section 6*a* is from about 10 mm to about 20 mm, or from about 10 mm to about 15 mm, or from about 12 to about 15 mm, for instance about 12 mm. In the present example, the length of the second tubular section 6*b* is 12 mm.

Preferably, the third plug wrap has a basis weight of less than 50 gsm, more preferably between about 20 gsm and 45 gsm. Preferably, the third plug wrap has a thickness of between 30 μm and 60 μm, more preferably between 35 μm and 45 μm. The third plug wrap is preferably a non-porous plug wrap having a permeability of less than 100 Coresta Units, for instance less than 50 Coresta Units. However, in alternative embodiments, the third plug wrap can be a porous plug wrap, for instance having a permeability of greater than 200 Coresta Units.

The first and second tubular sections 6*a*, 6*b* are each located around and define respective air gaps within the mouthpiece 2 which act as cooling segments. The air gaps provide chambers through which heated volatilized components generated by the aerosol generating material 3 flow.

Preferably, the first cavity 7*a* has an internal volume greater than about 40 $mm^3$ and/or the second cavity 7*b* has an internal volume greater than about 150 $mm^3$. Providing cavities of at least these volumes has been found to enable the formation of an improved aerosol, as well as providing the cooling function described herein. Such cavity sizes provide sufficient space within the mouthpiece 2 to allow heated volatilized components to cool, therefore allowing the exposure of the aerosol generating material 3 to higher temperatures than would otherwise be possible, since they may result in an aerosol which is too warm. The second cavity can, for instance, have an internal volume greater than 500 $mm^3$, for instance greater than 550 $mm^3$, 600 $mm^3$, 650 $mm^3$, or 700 $mm^3$, allowing further improvement of the aerosol. In some examples, the second cavity 7*b* comprises a volume of between about 550 $mm^3$ and about 750 $mm^3$, for instance about 600 $mm^3$ or 700 $mm^3$. The first cavity can, for instance, have an internal volume greater than 50 $mm^3$, for instance greater than 55 $mm^3$, 60 $mm^3$, or 65 $mm^3$, allowing further improvement of the aerosol. In some examples, the first cavity 7*a* comprises a volume of between about 40 $mm^3$ and about 150 $mm^3$, or between about 50 $mm^3$ and about 90 $mm^3$ for instance about 60 $mm^3$ or about 70 $mm^3$.

The second tubular section 6*b* can be configured to provide a temperature differential of at least 40 degrees Celsius between a heated volatilized component entering a first, upstream end of the second tubular section 6*b* and a heated volatilized component exiting a second, downstream end of the second tubular section 6*b*. The second tubular section 6*b* is preferably configured to provide a temperature differential of at least 60 degrees Celsius, preferably at least 80 degrees Celsius and more preferably at least 100 degrees Celsius between a heated volatilized component entering a first, upstream end of the second tubular section 6*b* and a heated volatilized component exiting a second, downstream end of the second tubular section 6*b*. This temperature differential across the length of the second tubular section 6*b* protects the temperature sensitive second body of material 5 from the high temperatures of the aerosol generating material 3 when it is heated.

The first tubular section 6*a* can be configured to provide a temperature differential of at least 5 degrees Celsius between a heated volatilized component entering a first, upstream end of the first tubular section 6*a* and a heated volatilized component exiting a second, downstream end of the first tubular section 6*a*. The first tubular section 6*a* is preferably configured to provide a temperature differential of at least 10 degrees Celsius, preferably at least 12 degrees Celsius and more preferably at least 15 degrees Celsius between a heated volatilized component entering a first, upstream end of the first tubular section 6*a* and a heated volatilized component exiting a second, downstream end of the first tubular section 6*a*.

The mouthpiece 2 of the article 1 comprises an upstream end 2*a* adjacent to the aerosol generating substrate 3 and a downstream end 2*b* distal from the aerosol generating substrate 3.

The pressure drop or difference (also referred to a resistance to draw) across the mouthpiece, for instance the part of the article 1 downstream of the aerosol generating material 3, is preferably less than about 60 mmH2O. More preferably, the pressure drop across the mouthpiece 2 is less than about 50 mmH2O. In some embodiments, particularly improved aerosol has been achieved using a mouthpiece 2 having a pressure drop of less than 40 mmH2O. Alternatively or additionally, the mouthpiece pressure drop can be at least 10 mmH2O, preferably at least 15 mmH2O and more preferably at least 20 mmH2O. In some embodiments, the mouthpiece pressure drop can be between about 15 mmH2O and 60 mmH2O. These values enable the mouthpiece 2 to slow down the aerosol as it passes through the mouthpiece 2 such that the temperature of the aerosol has time to reduce before reaching the downstream end 2*b* of the mouthpiece 2.

In the present example, the aerosol generating material 3 is wrapped in a wrapper 10. The wrapper 10 can, for instance, be a paper or paper-backed foil wrapper. In the present example, the wrapper 10 is substantially impermeable to air. In alternative embodiments, the wrapper 10 preferably has a permeability of less than 100 Coresta Units, more preferably less than 60 Coresta Units. It has been found that low permeability wrappers, for instance having a permeability of less than 100 Coresta Units, more preferably less than 60 Coresta Units, results in an improvement in the aerosol formation in the aerosol generating material 3. Without wishing to be bound by theory, it is hypothesized that this is due to reduced loss of aerosol compounds through the wrapper 10. The permeability of the wrapper 10 can be measured in accordance with ISO 2965:2009 concerning the determination of air permeability for materials used as cigarette papers, filter plug wrap and filter joining paper.

In the present embodiment, the wrapper 10 comprises aluminum foil. Aluminum foil has been found to be particularly effective at enhancing the formation of aerosol within the aerosol generating material 3. In the present example, the aluminum foil has a metal layer having a thickness of about 6 μm. In the present example, the aluminum foil has a paper backing. However, in alternative arrangements, the aluminum foil can be other thicknesses, for instance between 4 μm and 16 μm in thickness. The aluminum foil also need not have a paper backing, but could have a backing formed from other materials, for instance to help provide an appropriate tensile strength to the foil, or it could have no backing material. Metallic layers or foils other than aluminum can also be used. The total thickness of the wrapper is preferably between 20 μm and 60 μm, more preferably between 30 μm and 50 μm, which can provide a wrapper having appropriate structural integrity and heat transfer characteristics. The tensile force which can be applied to the wrapper before it breaks can be greater than 3,000 grams force, for instance between 3,000 and 10,000 grams force or between 3,000 and 4,500 grams force.

In some examples, the wrapper 10 surrounding the aerosol generating material comprises citrate, such as sodium citrate and/or potassium citrate. In such examples, the wrapper 10 may have a citrate content of 2% by weight or less, or 1% by weight or less. Reducing the citrate content of the wrapper can assist with reducing any visible discoloration of the wrapper during use.

In some examples, the wrapper 10 surrounding the aerosol generating material has a high level of permeability, for example greater than about 1000 Coresta Units, or greater than about 1500 Coresta Units, or greater than about 2000 Coresta Units. The permeability of the wrapper 10 can be measured in accordance with ISO 2965:2009 concerning the determination of air permeability for materials used as cigarette papers, filter plug wrap and filter joining paper.

The wrapper 10 may be formed from a material with a high inherent level of permeability, an inherently porous material, or may be formed from a material with any level of inherent permeability where the final level of permeability is achieved by providing the wrapper 10 with a permeable zone or area. Providing a permeable wrapper 10 provides a route for air to enter the smoking article. The wrapper can be provided with a permeability such that the amount of air entering through the rod of aerosol generating material is relatively more than the amount of air entering the article through the ventilation area 12 in the mouthpiece. An article having this arrangement may produce a more flavorsome aerosol, which may be more satisfactory to the user.

The article has a ventilation level of about 75% of the aerosol drawn through the article. In alternative embodiments, the article can have a ventilation level of between 50% and 80% of aerosol drawn through the article, for instance between 65% and 75%. Ventilation at these levels helps to slow down the flow of aerosol drawn through the mouthpiece 2 and thereby enable the aerosol to cool sufficiently before it reaches the downstream end 2*b* of the mouthpiece 2. The ventilation is provided directly into the mouthpiece 2 of the article 1. In the present example, the ventilation is provided into the first tubular section 6*a*, which has been found to be particularly beneficial in assisting with the aerosol generation process. In alternative examples, the ventilation can be provided into the second tubular section 6*b*, or into both the first and second tubular sections 6*a*, 6*b*. The ventilation is provided via first and second parallel rows of perforations 12, in the present case formed as laser perforations. These perforations pass though the tipping paper 8, third plug wrap and first tubular section 6*a*. In alternative embodiments, the ventilation can be provided into the mouthpiece at other locations.

Alternatively, the ventilation can be provided via a single row of perforations, for instance laser perforations, into the portion of the article in which the hollow tubular element is located. This has been found to result in improved aerosol formation, which is thought to result from the airflow through the perforations being more uniform than with multiple rows of perforations, for a given ventilation level.

Aerosol temperature has been found to generally increase with a drop in the ventilation level. However the relationship between aerosol temperature and ventilation level does not appear to be linear, with variations in ventilation, for instance due to manufacturing tolerances, having less impact at lower target ventilation levels. For instance, with a ventilation tolerance of ±15%, for a target ventilation level of 75%, the aerosol temperature could increase by approximately 6° C. at the lower ventilation limit (60% ventilation). However, with a target ventilation level of 60% the aerosol temperature may only increase by approximately 3.5° C. at the lower vent limit (45% ventilation). The target ventilation level of the article can therefore be within the range 40% to 70%, for instance, 45% to 65%. The mean ventilation level of at least 20 articles can be between 40% and 70%, for instance between 45% and 70% or between 51% and 59%.

In the present example, the aerosol forming material added to the aerosol generating substrate 3 comprises 14% by weight of the aerosol generating substrate 3. Preferably, the aerosol forming material comprises at least 5% by weight of the aerosol generating substrate, more preferably at least 10%. Preferably, the aerosol forming material comprises less than 25% by weight of the aerosol generating substrate, more preferably less than 20%, for instance between 10% and 20%, between 12% and 18% or between 13% and 16%.

Preferably, the aerosol generating material 3 is provided as a cylindrical rod of aerosol generating material. Irrespective of the form of the aerosol generating material, it preferably has a length of about 10 mm to 100 mm. In some embodiments, the length of the aerosol generating material is preferably in the range about 25 mm to 50 mm, more preferably in the range about 30 mm to 45 mm, and still more preferably about 30 mm to 40 mm.

The volume of aerosol generating material 3 provided can vary from about 200 mm3 to about 4300 mm3, preferably from about 500 mm3 to 1500 mm3, more preferably from about 1000 mm3 to about 1300 mm3. The provision of these volumes of aerosol generating material, for instance from about 1000 mm3 to about 1300 mm3, has been advantageously shown to achieve a superior aerosol, having a greater visibility and sensory performance compared to that achieved with volumes selected from the lower end of the range.

The mass of aerosol generating material 3 provided can be greater than 200 mg, for instance from about 200 mg to 400 mg, preferably from about 230 mg to 360 mg, more preferably from about 250 mg to 360 mg. It has been advantageously found that providing a higher mass of aerosol generating material results in improved sensory performance compared to aerosol generated from a lower mass of tobacco material.

Preferably, the aerosol generating material or substrate is formed from tobacco material as described herein, which includes a tobacco component.

In the tobacco material described herein, the tobacco component preferably contains paper-reconstituted tobacco. The tobacco component may also contain leaf tobacco, extruded tobacco, and/or bandcast tobacco.

The aerosol generating material 3 can comprise reconstituted tobacco material having a density of less than about 700 milligrams per cubic centimeter (mg/cc). Such tobacco material has been found to be particularly effective at providing an aerosol generating material, which can be heated quickly to release an aerosol, as compared to denser materials. For instance, the inventors tested the properties of various aerosol generating materials, such as bandcast reconstituted tobacco material and paper reconstituted tobacco material, when heated. It was found that, for each given aerosol generating material, there is a particular zero heat flow temperature below which net heat flow is endothermic, in other words more heat enters the material than leaves the material, and above which net heat flow is exothermic, in other words more heat leaves the material than enters the material, while heat is applied to the material. Materials having a density less than 700 mg/cc had a lower zero heat flow temperature. Since a significant portion of the heat flow out of the material is via the formation of aerosol, having a lower zero heat flow temperature has a beneficial effect on the time it takes to first release aerosol from the aerosol generating material. For instance, aerosol generating materials having a density of less than 700 mg/cc were found to have a zero heat flow temperature of less than 164° C., as compared to materials with a density over 700 mg/cc, which had zero heat flow temperatures greater than 164° C.

The density of the aerosol generating material also has an impact on the speed at which heat conducts through the material, with lower densities, for instance those below 700 mg/cc, conducting heat more slowly through the material, and therefore enabling a more sustained release of aerosol.

Preferably, the aerosol generating material 3 comprises reconstituted tobacco material having a density of less than about 700 mg/cc, for instance paper reconstituted tobacco material. More preferably, the aerosol generating material 3 comprises reconstituted tobacco material having a density of less than about 600 mg/cc. Alternatively or in addition, the aerosol generating material 3 preferably comprises reconstituted tobacco material having a density of at least 350 mg/cc, which is considered to allow for a sufficient amount of heat conduction through the material.

The tobacco material may be provided in the form of cut rag tobacco. The cut rag tobacco can have a cut width of at least 15 cuts per inch (about 5.9 cuts per cm, equivalent to a cut width of about 1.7 mm). Preferably, the cut rag tobacco has a cut width of at least 18 cuts per inch (about 7.1 cuts per cm, equivalent to a cut width of about 1.4 mm), more preferably at least 20 cuts per inch (about 7.9 cuts per cm, equivalent to a cut width of about 1.27 mm). In one example, the cut rag tobacco has a cut width of 22 cuts per inch (about 8.7 cuts per cm, equivalent to a cut width of about 1.15 mm). Preferably, the cut rag tobacco has a cut width at or below 40 cuts per inch (about 15.7 cuts per cm, equivalent to a cut width of about 0.64 mm). Cut widths between 0.5 mm and 2.0 mm, for instance between 0.6 mm and 1.5 mm, or between 0.6 mm and 1.7 mm have been found to result in tobacco material which is preferably in terms of surface area to volume ratio, particularly when heated, and the overall density and pressure drop of the substrate 3. The cut rag tobacco can be formed from a mixture of forms of tobacco material, for instance a mixture of one or more of paper reconstituted tobacco, leaf tobacco, extruded tobacco and bandcast tobacco. Preferably, the tobacco material comprises paper reconstituted tobacco or a mixture of paper reconstituted tobacco and leaf tobacco.

In the tobacco material described herein, the tobacco material may contain a filler component. The filler component is generally a non-tobacco component, that is, a component that does not include ingredients originating from tobacco. The filler component may be a non-tobacco fiber such as wood fiber or pulp or wheat fiber. The filler component may also be an inorganic material such as chalk, perlite, vermiculite, diatomaceous earth, colloidal silica, magnesium oxide, magnesium sulphate, magnesium carbonate. The filler component may also be a non-tobacco cast material or a non-tobacco extruded material. The filler component may be present in an amount of 0 to 20% by weight of the tobacco material, or in an amount of from 1 to 10% by weight of the composition. In some embodiments, the filler component is absent.

In the tobacco material described herein, the tobacco material contains an aerosol forming material. In this context, an "aerosol forming material" is an agent that promotes the generation of an aerosol. An aerosol forming material may promote the generation of an aerosol by promoting an initial vaporization and/or the condensation of a gas to an inhalable solid and/or liquid aerosol. In some embodiments, an aerosol forming material may improve the delivery of flavor from the aerosol generating material. In general, any suitable aerosol forming material or agents may be included in the aerosol generating material of the invention, including those described herein. Other suitable aerosol forming materials include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. In some embodiments, the aerosol forming material may be glycerol, propylene glycol, or a mixture of glycerol and propylene glycol. The total amount of glycerol, propylene glycol, or a mixture of glycerol and propylene glycol used may be in the range of between 10% and 30%, for instance between 15% and 25% of the tobacco material measured on a dry weight basis. Glycerol may be present in an amount of from 10 to 20% by weight of the tobacco material, for example 13 to 16% by weight of the composition, or about 14% or 15% by weight of the composition. Propylene glycol, if present, may be present in an amount of from 0.1 to 0.3% by weight of the composition.

The aerosol forming material may be included in any component, for example any tobacco component, of the tobacco material, and/or in the filler component, if present. Alternatively or additionally, the aerosol forming material may be added to the tobacco material separately. In either case, the total amount of the aerosol forming material in the tobacco material can be as defined herein.

The tobacco material can contain between 10% and 90% by weight tobacco leaf, wherein the aerosol forming material is provided in an amount of up to about 10% by weight of the leaf tobacco. To achieve an overall level of aerosol forming material between 10% and 20% by weight of the tobacco material, it has been advantageously found that this can be added in higher weight percentages to the another component of the tobacco material, such as reconstituted tobacco material.

The tobacco material described herein contains nicotine. The nicotine content is from 0.5 to 1.75% by weight of the tobacco material, and may be, for example, from 0.8 to 1.5% by weight of the tobacco material. Additionally or alternatively, the tobacco material contains between 10% and 90% by weight tobacco leaf having a nicotine content of greater than 1.5% by weight of the tobacco leaf. It has been advantageously found that using a tobacco leaf with nicotine content higher than 1.5% in combination with a lower nicotine base material, such as paper reconstituted tobacco, provides a tobacco material with an appropriate nicotine level but better sensory performance than the use of paper reconstituted tobacco alone. The tobacco leaf, for instance cut rag tobacco, can, for instance, have a nicotine content of between 1.5% and 5% by weight of the tobacco leaf.

The tobacco material described herein can contain an aerosol-modifying agent, such as any of the flavors described herein. In one embodiment, the tobacco material contains menthol, forming a mentholated article. The tobacco material can comprise from 3 mg to 20 mg of menthol, preferably between 5 mg and 18 mg and more preferably between 8 mg and 16 mg of menthol. In the present example, the tobacco material comprises 16 mg of menthol. The tobacco material can contain between 2% and 8% by weight of menthol, preferably between 3% and 7% by weight of menthol and more preferably between 4% and 5.5% by weight of menthol. In one embodiment, the tobacco material includes 4.7% by weight of menthol. Such high levels of menthol loading can be achieved using a high percentage of reconstituted tobacco material, for instance greater than 50% of the tobacco material by weight. Alternatively or additionally, the use of a high volume of aerosol generating material, for instance tobacco material, can increase the level of menthol loading that can be achieved, for instance where greater than about 500 mm3 or suitably more than about 1000 mm3 of aerosol generating material, such as tobacco material, are used.

In the compositions described herein, where amounts are given in % by weight, for the avoidance of doubt this refers to a dry weight basis, unless specifically indicated to the contrary. Thus, any water that may be present in the tobacco material, or in any component thereof, is entirely disregarded for the purposes of the determination of the weight %. The water content of the tobacco material described herein may vary and may be, for example, from 5 to 15% by weight. The water content of the tobacco material described herein may vary according to, for example, the temperature, pressure and humidity conditions at which the compositions are maintained. The water content can be determined by Karl-Fisher analysis, as known to those skilled in the art. On the other hand, for the avoidance of doubt, even when the aerosol forming material is a component that is in liquid phase, such as glycerol or propylene glycol, any component other than water is included in the weight of the tobacco material. However, when the aerosol forming material is provided in the tobacco component of the tobacco material, or in the filler component (if present) of the tobacco material, instead of or in addition to being added separately to the tobacco material, the aerosol forming material is not included in the weight of the tobacco component or filler component, but is included in the weight of the "aerosol forming material" in the weight % as defined herein. All other ingredients present in the tobacco component are included in the weight of the tobacco component, even if of non-tobacco origin (for example non-tobacco fibers in the case of paper reconstituted tobacco).

In an embodiment, the tobacco material comprises the tobacco component as defined herein and the aerosol forming material as defined herein. In an embodiment, the tobacco material consists essentially of the tobacco component as defined herein and the aerosol forming material as defined herein. In an embodiment, the tobacco material consists of the tobacco component as defined herein and the aerosol forming material as defined herein.

Paper reconstituted tobacco is present in the tobacco component of the tobacco material described herein in an amount of from 10% to 100% by weight of the tobacco component. In embodiments, the paper-reconstituted tobacco is present in an amount of from 10% to 80% by weight, or 20% to 70% by weight, of the tobacco component. In a further embodiment, the tobacco component consists essentially of, or consists of, paper-reconstituted tobacco. In preferred embodiments, leaf tobacco is present in the tobacco component of the tobacco material in an amount of from at least 10% by weight of the tobacco component. For instance, leaf tobacco can be present in an amount of at least 10% by weight of the tobacco component, while the remainder of the tobacco component comprises paper reconstituted tobacco, bandcast reconstituted tobacco, or a combination of bandcast reconstituted tobacco and another form of tobacco such as tobacco granules.

Paper reconstituted tobacco refers to tobacco material formed by a process in which tobacco feedstock is extracted with a solvent to afford an extract of solubles and a residue comprising fibrous material, and then the extract (usually after concentration, and optionally after further processing) is recombined with fibrous material from the residue (usually after refining of the fibrous material, and optionally with the addition of a portion of non-tobacco fibers) by deposition of the extract onto the fibrous material. The process of recombination resembles the process for making paper.

The paper-reconstituted tobacco may be any type of paper reconstituted tobacco that is known in the art. In a particular embodiment, the paper-reconstituted tobacco is made from a feedstock comprising one or more of tobacco strips, tobacco stems, and whole leaf tobacco. In a further embodiment, the paper-reconstituted tobacco is made from a feedstock consisting of tobacco strips and/or whole leaf tobacco, and tobacco stems. However, in other embodiments, scraps, fines and winnowings can alternatively or additionally be employed in the feedstock.

The paper-reconstituted tobacco for use in the tobacco material described herein may be prepared by methods which are known to those skilled in the art for preparing paper reconstituted tobacco.

Figure 2:
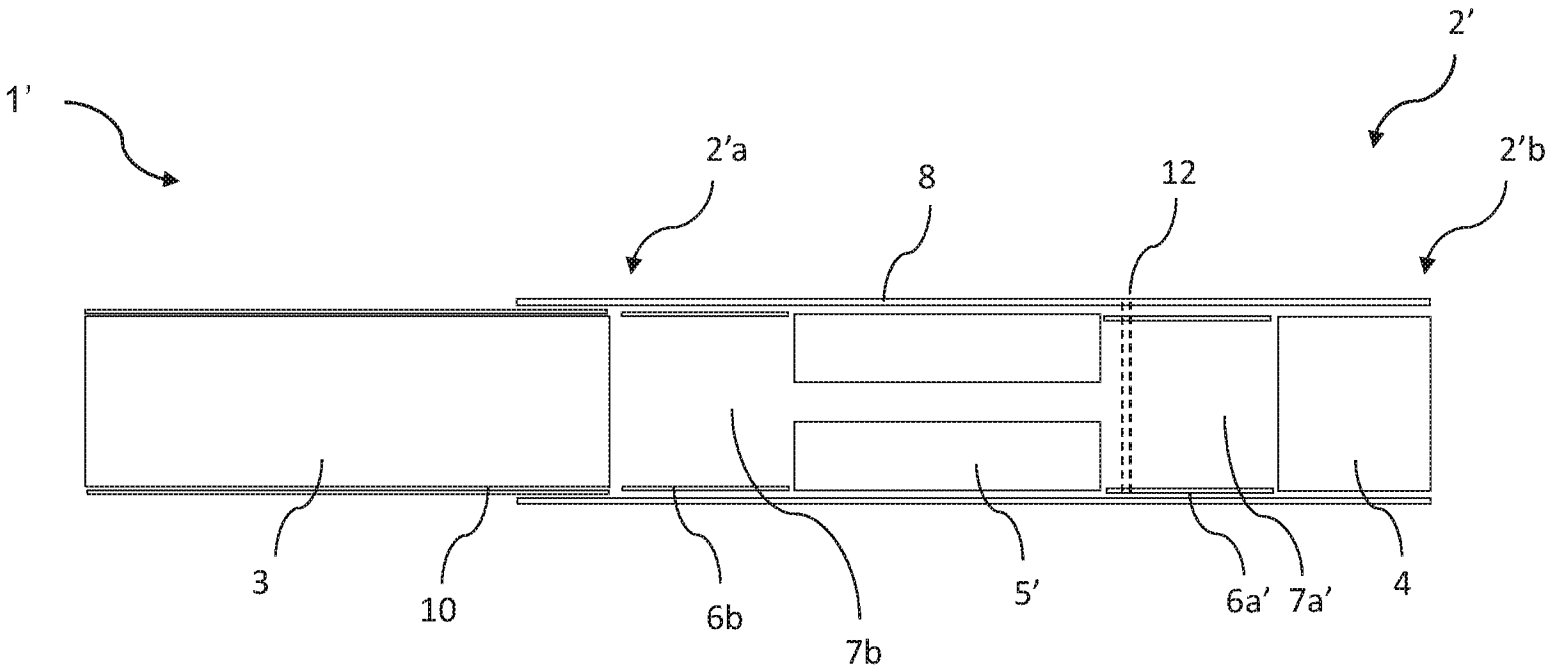
FIG. 2 is a side-on cross sectional view of an article for use as part of a non-combustible aerosol provision system, the article including a component having a tubular body disposed between a first tubular section and a second tubular section.

FIG. 2 is a side-on cross sectional view of a further article 1' for use with a non-combustible aerosol provision device, the article 1' including a component 2' having a tubular body 5' disposed between a first tubular section 6*a*' and a second tubular section 6*b*'. Component 2' of FIG. 2 is substantially the same as component 2 described above with reference to FIG. 1, except that the first tubular section 6*a*' is formed as a paper tube in the same way as the second tubular section 6*b* described with reference to FIG. 1, and the second body of material 5' is a tubular body.

The mouthpiece 2' of the article 1' comprises an upstream end 2'*a* adjacent to the aerosol generating substrate 3 and a downstream end 2'*b* distal from the aerosol generating substrate 3.

The tubular body 5' can be made from materials as described herein, such as filamentary tow materials described herein. The tubular body 5' can have a length corresponding to the length of the second body 5 described with reference to FIG. 1. In the present example, the length of the tubular body 5' is about 15 mm.

The "wall thickness" of the tubular body 5' corresponds to the thickness of the wall of the body in a radial direction. This may be measured in the same way as that of the first and second tubular sections 6*a*, 6*b*. The wall thickness is advantageously greater than 0.9 mm, and more preferably 1.0 mm or greater. Preferably, the wall thickness is substantially constant around the entire wall of the tubular body 5'. However, where the wall thickness is not substantially constant, the wall thickness is preferably greater than 0.9 mm at any point around the tubular body 5', more preferably 1.0 mm or greater. In some examples, the wall thickness is advantageously greater than about 1.5 mm, or greater than about 2.0 mm. The wall thickness can, for instance, be between about 1.0 mm and about 4.0 mm, or between about 1.0 mm and about 3.0 mm. The channel through the tubular body 5' is, in the present example, approximately centered on the longitudinal axis of the tubular body 5'. However, in other examples, the channel can be offset from the longitudinal axis. The diameter of the channel can be from about 0.5 mm to about 5 mm, for instance from about 0.5 mm to about 4 mm or from about 1.0 mm to about 3 mm.

Preferably, the density of the tubular body 5' is at least about 0.25 grams per cubic centimeter (g/cc), more preferably at least about 0.3 g/cc. Preferably, the density of the tubular body 5' is less than about 0.75 grams per cubic centimeter (g/cc), more preferably less than 0.6 g/cc. In some embodiments, the density of the tubular body 5' is between 0.25 and 0.75 g/cc, more preferably between 0.3 and 0.6 g/cc, and more preferably between 0.4 g/cc and 0.6 g/cc or about 0.5 g/cc. These densities have been found to provide a good balance between improved firmness afforded by denser material and the lower heat transfer properties of lower density material. For the purposes of the present invention, the "density" of the tubular body 5' refers to the density of the filamentary tow forming the element with any plasticizer incorporated. The density may be determined by dividing the total weight of the tubular body 5' by the total volume of the tubular body 5', wherein the total volume can be calculated using appropriate measurements of the tubular body 5' taken, for example, using calipers. Where necessary, the appropriate dimensions may be measured using a microscope.

Figure 3:
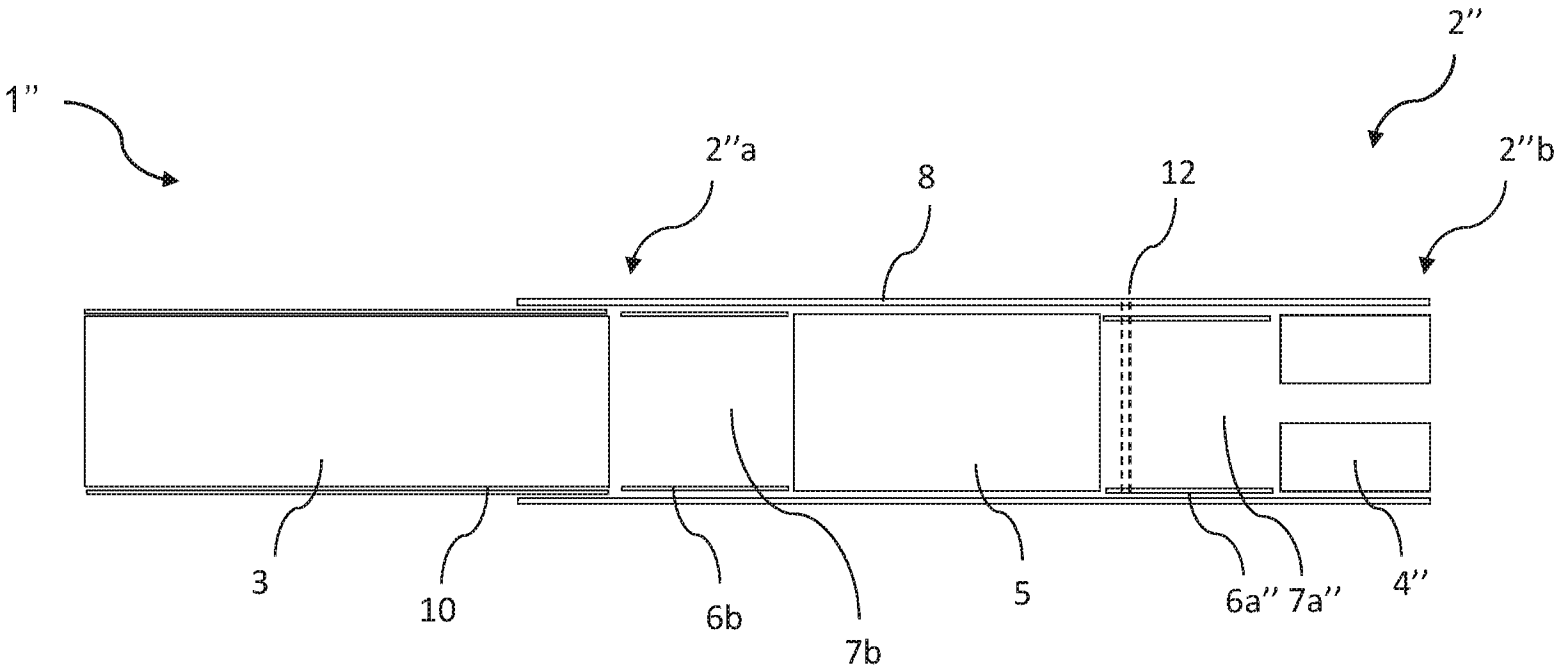
FIG. 3 is a side-on cross sectional view of an article for use as part of a non-combustible aerosol provision system, the article including a component having a tubular body at the mouth end and a continuous body disposed between a first tubular section and a second tubular section.

FIG. 3 is a side-on cross sectional view of a further article 1" for use with a non-combustible aerosol provision device, the article including a component 2" having a tubular body 4" at the mouth end and a continuous body 5 disposed between a first tubular section 6*a*" and a second tubular section 6*b*. The first tubular section 6*a*" defines a first cavity 7*a*".

Article 1" and component 2" are the same as the article 1 and component 2 illustrated in FIG. 1, except that the first tubular section 6*a*" is formed as a paper tube in the same way as the second tubular section 6*b* described with reference to FIG. 1, and the first body of material 4" is a tubular body. The first body of material 4" can be formed from the same materials and have the same density and dimensions as the tubular body of material 5' described with reference to FIG. 2.

The mouthpiece 2" of the article 1" comprises an upstream end 2" a adjacent to the aerosol generating substrate 3 and a downstream end 2"*b* distal from the aerosol generating substrate 3.

In some embodiments, it can be advantageous to use a first body of material 4" having a length of greater than about 10 mm, for instance between about 10 mm and about 30 mm or between about 12 mm and about 25 mm. It has been found that a consumer's lips are likely to extend in some cases to about 12 mm from the mouth end of the article 1 when drawing aerosol through the article 1, and therefore a first body of material 4" having a length of at least 10 mm or at least 12 mm means that most of the consumer's lips surround this element.

A non-combustible aerosol provision device is used to heat the aerosol generating material 3 of the articles 1, 1', 1" described herein. The non-combustible aerosol provision device preferably comprises a coil, since this has been found to enable improved heat transfer to the article 1, 1', 1" as compared to other arrangements.

In some examples, the coil is configured to, in use, cause heating of at least one electrically-conductive heating element, so that heat energy is conductible from the at least one electrically-conductive heating element to the aerosol generating material to thereby cause heating of the aerosol generating material.

In some examples, the coil is configured to generate, in use, a varying magnetic field for penetrating at least one heating element, to thereby cause induction heating and/or magnetic hysteresis heating of the at least one heating element. In such an arrangement, the or each heating element may be termed a "susceptor" as defined herein. A coil that is configured to generate, in use, a varying magnetic field for penetrating at least one electrically-conductive heating element, to thereby cause induction heating of the at least one electrically-conductive heating element, may be termed an "induction coil" or "inductor coil".

The device may include the heating element(s), for example, electrically-conductive heating element(s), and the heating element(s) may be suitably located or locatable relative to the coil to enable such heating of the heating element(s). The heating element(s) may be in a fixed position relative to the coil. Alternatively, the at least one heating element, for example at least one electrically-conductive heating element, may be included in the article 1, 1', 1" for insertion into a heating zone of the device, wherein the article 1, 1', 1" also comprises the aerosol generating material 3 and is removable from the heating zone after use. Alternatively, both the device and such an article 1, 1', 1" may comprise at least one respective heating element, for example at least one electrically-conductive heating element, and the coil may be to cause heating of the heating element(s) of each of the device and the article when the article is in the heating zone.

In some examples, the coil is helical. In some examples, the coil encircles at least a part of a heating zone of the device that is configured to receive aerosol-generating material. In some examples, the coil is a helical coil that encircles at least a part of the heating zone.

In some examples, the device comprises an electrically-conductive heating element that at least partially surrounds the heating zone, and the coil is a helical coil that encircles at least a part of the electrically-conductive heating element. In some examples, the electrically-conductive heating element is tubular. In some examples, the coil is an inductor coil.

In some examples, the use of a coil enables the non-combustible aerosol provision device to reach operational temperature more quickly than a non-coil aerosol provision device. For instance, the non-combustible aerosol provision device including a coil as described above can reach an operational temperature such that a first puff can be provided in less than 30 seconds from initiation of a device-heating program, more preferably in less than 25 seconds. In some examples, the device can reach an operational temperature in about 20 seconds from the initiation of a device-heating program.

The use of a coil as described herein in the device to cause heating of the aerosol generating material has been found to enhance the aerosol, which is produced. For instance, consumers have reported that the aerosol generated by a device including a coil such as that described herein is sensorially closer to that generated in factory made cigarette (FMC) products than the aerosol produced by other non-combustible aerosol provision systems. Without wishing to be bound by theory, it is hypothesized that this is the result of the reduced time to reach the required heating temperature when the coil is used, the higher heating temperatures achievable when the coil is used and/or the fact that the coil enables such systems to simultaneously heat a relatively large volume of aerosol generating material, resulting in aerosol temperatures resembling FMC aerosol temperatures. In FMC products, the burning coal generates a hot aerosol which heats tobacco in the tobacco rod behind the coal, as the aerosol is drawn through the rod. This hot aerosol is understood to release flavor compounds from tobacco in the rod behind the burning coal. A device including a coil as described herein is thought to also be capable of heating aerosol generating material, such as tobacco material described herein, to release flavor compounds, resulting in an aerosol which has been reported to more closely resemble an FMC aerosol. Particular improvements in aerosol can be achieved through the use of a device including a coil to heat an article comprising a rod of aerosol generating material having a circumference greater than 19 mm, for instance a circumference between about 19 mm and about 23 mm.

Using an aerosol provision system including a coil as described herein, for instance an induction coil which heats at least some of the aerosol generating material to at least 200° C., more preferably at least 220° C., can enable the generation of an aerosol from an aerosol generating material that has particular characteristics which are thought to more closely resemble those of an FMC product. For example, when heating an aerosol generating material, including nicotine, using an induction heater, heated to at least 250° C., for a two-second period, under an airflow of at least 1.50 L/m during the period, one or more of the following characteristics has been observed:

- at least 10 μg of nicotine is aerosolized from the aerosol generating material;
- the weight ratio in the generated aerosol, of aerosol forming material to nicotine is at least about 2.5:1, suitably at least 8.5:1;
- at least 100 μg of the aerosol forming material can be aerosolized from the aerosol generating material;
- the mean particle or droplet size in the generated aerosol is less than about 1000 nm; and
- the aerosol density is at least 0.1 μg/cc.

In some cases, at least 10 μg of nicotine, suitably at least 30 μg or 40 μg of nicotine, is aerosolized from the aerosol generating material under an airflow of at least 1.50 L/m during the period. In some cases, less than about 200 μg, suitably less than about 150 μg or less than about 125 μg, of nicotine is aerosolized from the aerosol generating material under an airflow of at least 1.50 L/m during the period.

In some cases, the aerosol contains at least 100 μg of the aerosol forming material, suitably at least 200 μg, 500 μg or 1 mg of aerosol forming material is aerosolized from the aerosol generating material under an airflow of at least 1.50 L/m during the period. Suitably, the aerosol forming material may comprise or consist of glycerol.

As defined herein, the term "mean particle or droplet size" refers to the mean size of the solid or liquid components of an aerosol (i.e. the components suspended in a gas). Where the aerosol contains suspended liquid droplets and suspended solid particles, the term refers to the mean size of all components together.

In some cases, the mean particle or droplet size in the generated aerosol may be less than about 900 nm, 800 nm, 700, nm 600 nm, 500 nm, 450 nm or 400 nm. In some cases, the mean particle or droplet size may be more than about 25 nm, 50 nm or 100 nm.

In some cases, the aerosol density generated during the period is at least 0.1 μg/cc. In some cases, the aerosol density is at least 0.2 μg/cc, 0.3 μg/cc or 0.4 μg/cc. In some cases, the aerosol density is less than about 2.5 μg/cc, 2.0 μg/cc, 1.5 μg/cc or 1.0 μg/cc.

The non-combustible aerosol provision device is preferably arranged to heat the aerosol generating material 3 of the article 1, 1', 1", to a maximum temperature of at least 160° C. Preferably, the non-combustible aerosol provision device is arranged to heat the aerosol forming material 3 of the article 1, 1', 1", to a maximum temperature of at least about 200° C., or at least about 220° C., or at least about 240° C., more preferably at least about 270° C., at least once during the heating process followed by the non-combustible aerosol provision device.

Using an aerosol provision system including a coil as described herein, for instance an induction coil which heats at least some of the aerosol generating material to at least 200° C., more preferably at least 220° C., can enable the generation of an aerosol from an aerosol generating material in an article 1, 1', 1" as described herein that has a higher temperature as the aerosol leaves the mouth end of the mouthpiece 2, 2', 2" than previous devices, contributing to the generation of an aerosol which is considered closer to an FMC product. For instance, the maximum aerosol temperature measured at the mouth-end of the article 1, 1', 1" can preferably be greater than 50° C., more preferably greater than 55° C. and still more preferably greater than 56° C. or 57° C. Additionally or alternatively, the maximum aerosol temperature measured at the mouth-end of the article 1, 1', 1" can be less than 62° C., more preferably less than 60° C. and more preferably less than 59° C. In some embodiments, the maximum aerosol temperature measured at the mouth-end of the article 1, 1', 1" can preferably be between 50° C. and 62° C., more preferably between 56° C. and 60° C.

Figure 4:
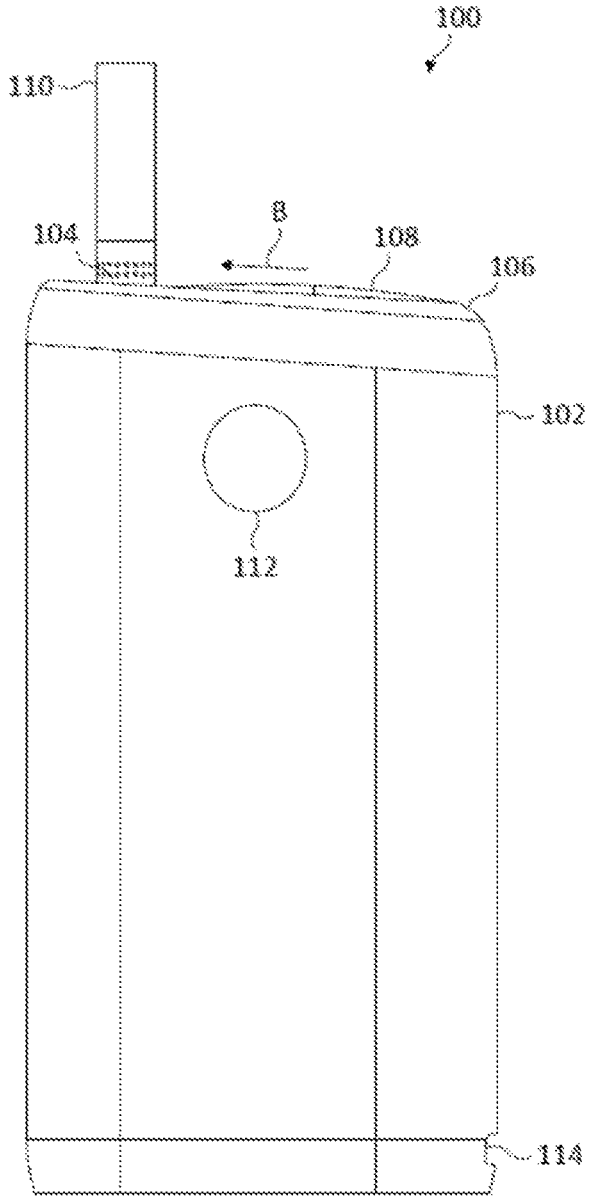
FIG. 4 is a perspective illustration of a non-combustible aerosol provision device for generating aerosol from the aerosol generating material of the articles of FIGS. 1, 2 and 3.

FIG. 4 shows an example of a non-combustible aerosol provision device 100 for generating aerosol from an aerosol generating medium/material such as the aerosol generating material 3 of the articles 1, 1', 1" described herein. In broad outline, the device 100 may be used to heat a replaceable article 110 comprising the aerosol-generating medium, for instance the articles 1, 1', 1" described herein, to generate an aerosol or other inhalable medium which is inhaled by a user of the device 100. The device 100 and replaceable article 110 together form a system.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

The device 100 of this example comprises a first end member 106, which comprises a lid 108 which is moveable relative to the first end member 106 to close the opening 104 when no article 110 is in place. In FIG. 4, the lid 108 is shown in an open configuration, however the lid 108 may move into a closed configuration. For example, a user may cause the lid 108 to slide in the direction of arrow "B".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port.

Figure 5:
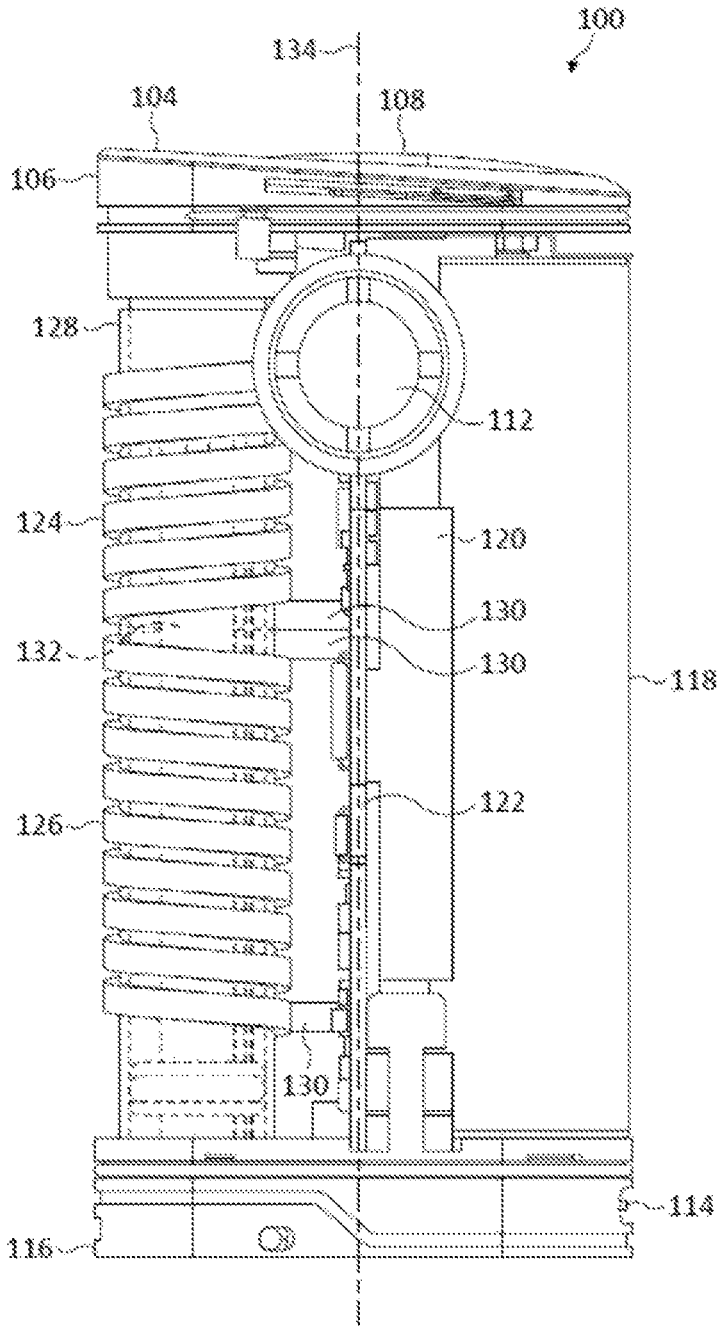
FIG. 5 illustrates the device of FIG. 4 with the outer cover removed and without an article present.

FIG. 5 depicts the device 100 of FIG. 4 with the outer cover 102 removed and without an article 110 present. The device 100 defines a longitudinal axis 134.

As shown in FIG. 5, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 110 into the opening 104, operates the user control 112 to begin heating the aerosol generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. Examples of suitable batteries include, for example, a lithium battery (such as a lithium-ion battery), a nickel battery (such as a nickel-cadmium battery), and an alkaline battery. The battery is electrically coupled to the heating assembly to supply electrical power when required and under control of a controller (not shown) to heat the aerosol generating material. In this example, the battery is connected to a central support 120, which holds the battery 118 in place.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 110 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element, and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from Litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper Litz wire, which has a rectangular cross section. In other examples the Litz wire can have other shape cross sections, such as circular.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction along the longitudinal axis 134 of the device 100 (that is, the first and second inductor coils 124, 126 to not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 5, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

In this example, the first inductor coil 124 and the second inductor coil 126 are wound in opposite directions. This can be useful when the inductor coils are active at different times. For example, initially, the first inductor coil 124 may be operating to heat a first section/portion of the article 110, and at a later time, the second inductor coil 126 may be operating to heat a second section/portion of the article 110. Winding the coils in opposite directions helps reduce the current induced in the inactive coil when used in conjunction with a particular type of control circuit. In FIG. 5, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a receptacle within which aerosol generating material is received. For example, the article 110 can be inserted into the susceptor 132. In this example the susceptor 120 is tubular, with a circular cross section.

The susceptor 132 may be made from one or more materials. Preferably the susceptor 132 comprises carbon steel having a coating of Nickel or Cobalt.

In some examples, the susceptor 132 may comprise at least two materials capable of being heated at two different frequencies for selective aerosolization of the at least two materials. For example, a first section of the susceptor 132 (which is heated by the first inductor coil 124) may comprise a first material, and a second section of the susceptor 132 which is heated by the second inductor coil 126 may comprise a second, different material. In another example, the first section may comprise first and second materials, where the first and second materials can be heated differently based upon operation of the first inductor coil 124. The first and second materials may be adjacent along an axis defined by the susceptor 132, or may form different layers within the susceptor 132. Similarly, the second section may comprise third and fourth materials, where the third and fourth materials can be heated differently based upon operation of the second inductor coil 126. The third and fourth materials may be adjacent along an axis defined by the susceptor 132, or may form different layers within the susceptor 132. Third material may the same as the first material, and the fourth material may be the same as the second material, for example. Alternatively, each of the materials may be different. The susceptor may comprise carbon steel or aluminium for example.

The device 100 of FIG. 5 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 5, the first and second inductor coils 124, 126 are positioned around the insulating member 128 and are in contact with a radially outward surface of the insulating member 128. In some examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 6:
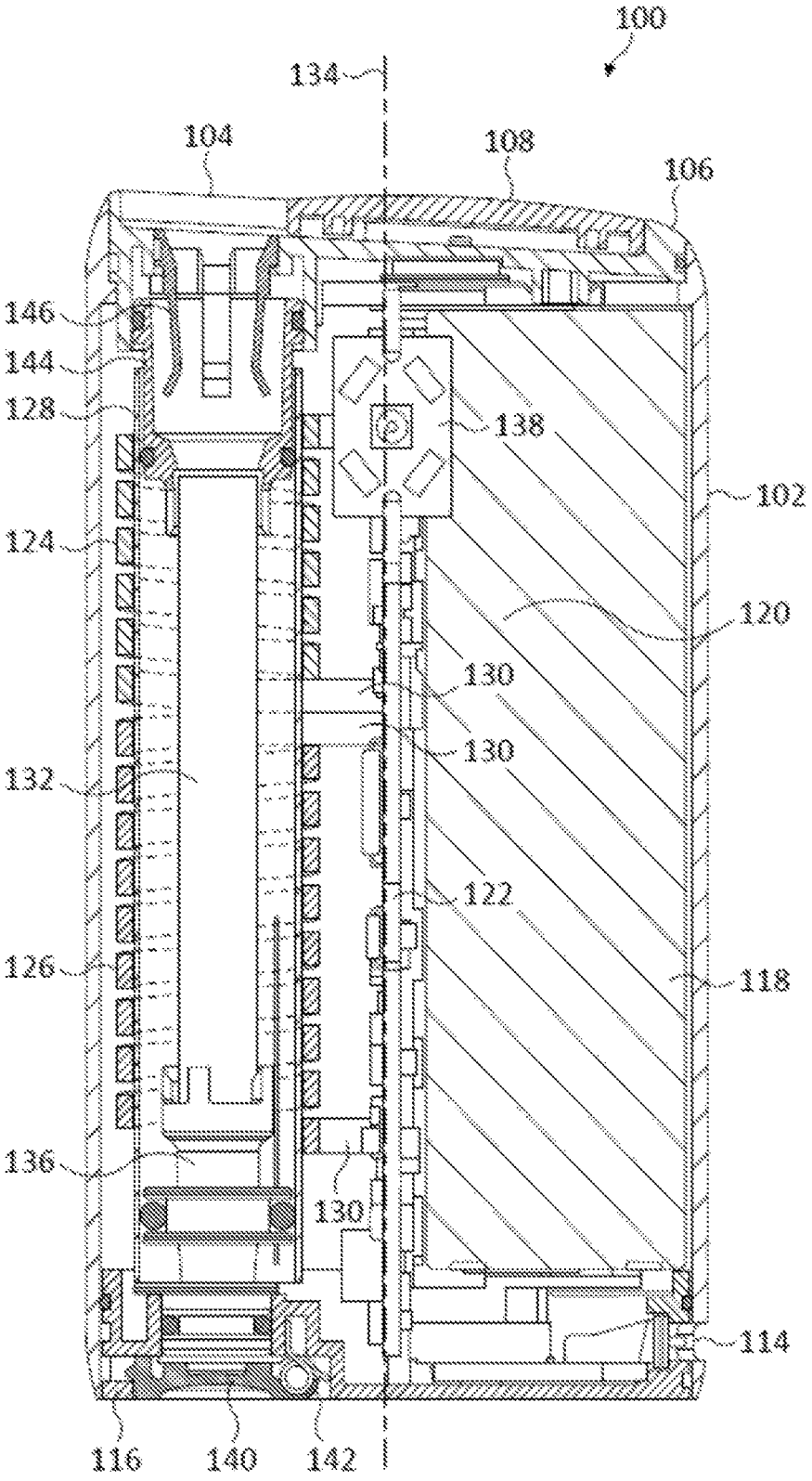
FIG. 6 is a side view of the device of FIG. 4 in partial cross-section.

FIG. 6 shows a side view of device 100 in partial cross-section. The outer cover 102 is present in this example. The rectangular cross-sectional shape of the first and second inductor coils 124, 126 is more clearly visible.

The device 100 further comprises a support 136 which engages one end of the susceptor 132 to hold the susceptor 132 in place. The support 136 is connected to the second end member 116.

The device may also comprise a second printed circuit board 138 associated within the control element 112.

The device 100 further comprises a second lid/cap 140 and a spring 142, arranged towards the distal end of the device 100. The spring 142 allows the second lid 140 to be opened, to provide access to the susceptor 132. A user may open the second lid 140 to clean the susceptor 132 and/or the support 136.

The device 100 further comprises an expansion chamber 144 which extends away from a proximal end of the susceptor 132 towards the opening 104 of the device. Located at least partially within the expansion chamber 144 is a retention clip 146 to abut and hold the article 110 when received within the device 100. The expansion chamber 144 is connected to the end member 106.

Figure 7:
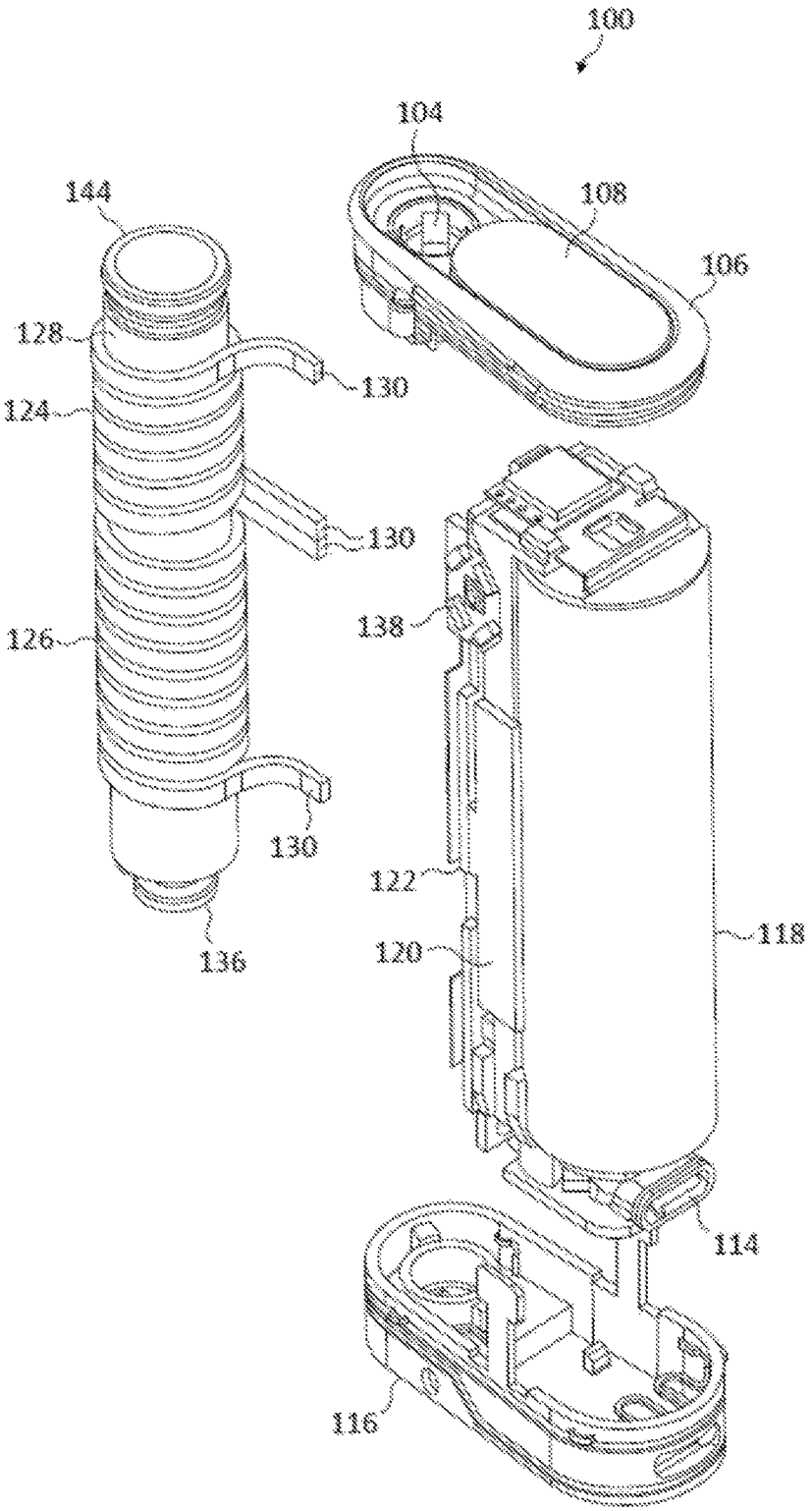
FIG. 7 is an exploded view of the device of FIG. 4, with the outer cover omitted.

FIG. 7 is an exploded view of the device 100 of FIG. 6, with the outer cover 102 omitted.

Figure 8A:
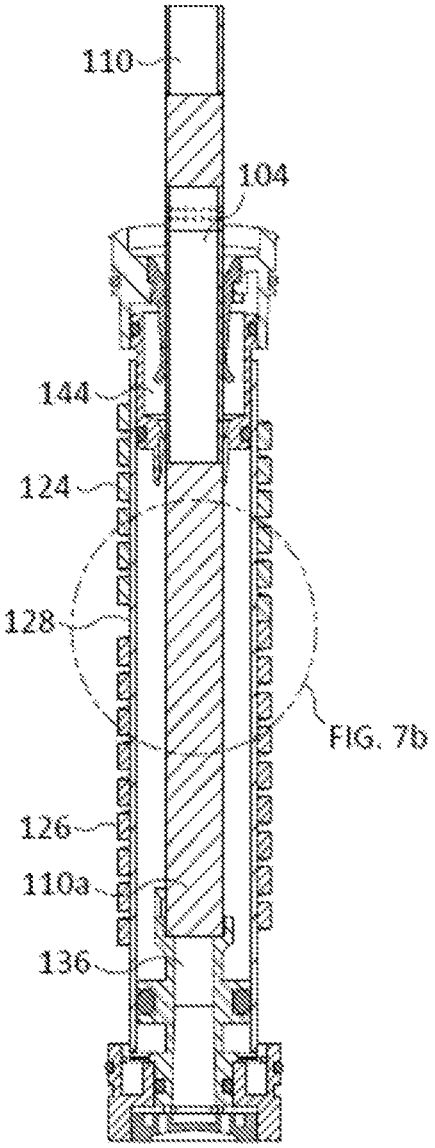
FIG. 8A is a cross sectional view of a portion of the device of FIG. 4.
Figure 8B:
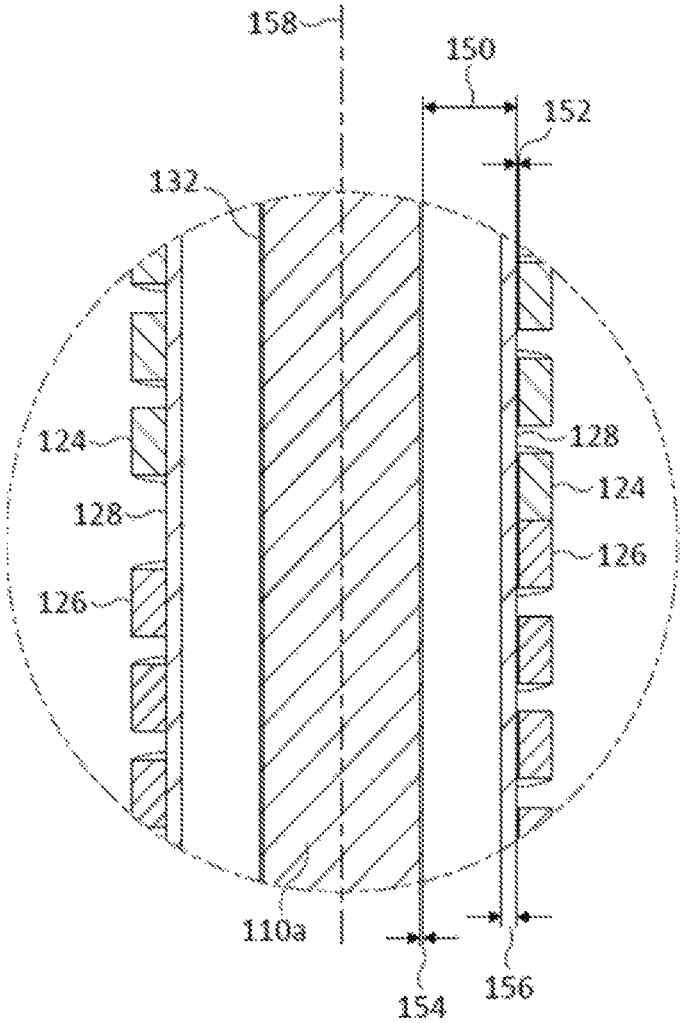
FIG. 8B is a close-up illustration of a region of the device of FIG. 8A.

FIG. 8A depicts a cross section of a portion of the device 100 of FIG. 6. FIG. 8B depicts a close-up of a region of FIG. 8A. FIGS. 7A and 7B show the article 110 received within the susceptor 132, where the article 110 is dimensioned so that the outer surface of the article 110 abuts the inner surface of the susceptor 132. This ensures that the heating is most efficient. The article 110 of this example comprises aerosol generating material 110*a*. The aerosol generating material 110*a* is positioned within the susceptor 132. The article 110 may also comprise other components such as a filter, wrapping materials and/or a cooling structure.

FIG. 8B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3-3.5 mm, or about 3.25 mm.

FIG. 8B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40 mm to 45 mm, or about 44.5 mm.

In one example, the insulating member 128 has a wall thickness 156 of about 0.25 mm to 2 mm, 0.25 mm to 1 mm, or about 0.5 mm.

In use, the articles 1, 1', 1" described herein can be inserted into a non-combustible aerosol provision device such as the device 100 described with reference to FIGS. 3 to 7. At least a portion of the mouthpiece 2, 2', 2" of the article 1, 1', 1" protrudes from the non-combustible aerosol provision device 100 and can be placed into a user's mouth. An aerosol is produced by heating the aerosol generating material 3 using the device 100. The aerosol produced by the aerosol generating material 3 passes through the mouthpiece 2 to the user's mouth.

When the article 1, 1', 1" is inserted into the device 100, the minimum distance between the one or more components of the heater assembly and a tubular element of the article 1, 1', 1" may be in the range 3 mm to 10 mm, for example 3 mm, 4 mm, 5 mm, 6 mm, 7 mm, 8 mm, 9 mm or 10 mm.

The articles 1, 1', 1" described herein have particular advantages, for instance when used with non-combustible aerosol provision devices such as the device 100 described with reference to FIGS. 3 to 7. In particular, the first tubular element 4 formed from filamentary tow has surprisingly been found to have a significant influence on the temperature of the outer surface of the mouthpiece 2 of the articles 1, 1', 1". For instance, where the hollow tubular element 8 formed from filamentary tow is wrapped in an outer wrapper, for instance the tipping paper 5, an outer surface of the outer wrapper at a longitudinal position corresponding to the location of the hollow tubular element 8 has been found to reach a maximum temperature of less than 42° C. during use, suitably less than 40° C. and more suitably less than 38° C. or less than 36° C.

In some embodiments, a non-combustible aerosol provision system is provided comprising an aerosol modifying component and a heater which, in use, is operable to heat the aerosol generating material such that the aerosol generating material provides an aerosol. The aerosol modifying component comprises at least one capsule, for instance first and second capsules. The first capsule is disposed in a first portion of the aerosol modifying component and the second capsule is disposed in a second portion of the aerosol modifying component downstream of the first portion.

The first portion of the aerosol modifying component is heated to a first temperature during operation of the heater to generate the aerosol and the second portion is heated to a second temperature during operation of the heater to generate aerosol, wherein the second temperature is at least 4 degrees Celsius lower than the first temperature. Preferably, the second temperature is at least 5, 6, 7, 8, 9 or 10 degrees Celsius lower than the first temperature.

The aerosol modifying component may comprise one or more components of the article. In some embodiments, the aerosol modifying component comprises a body of material, wherein the first and second capsules are disposed in the body of material. The body of material may comprise cellulose acetate. In another embodiment, the aerosol modifying component comprises two bodies of material, wherein the first and second capsules are disposed in the first and second bodies respectively. In some embodiments, the aerosol modifying component alternatively or additionally comprises one or more tubular elements upstream and/or downstream of the body or bodies of material. The aerosol generating component may comprise the mouthpiece.

In some embodiments, the second capsule is spaced from the first capsule by a distance of at least 7 mm, measured as the distance between the center of the first and second capsules. Preferably, the second capsule is spaced from the first capsule by a distance of at least 8, 9 or 10 mm. It has been found that increasing the distance between the first and second capsules increases the difference between the first and second temperatures.

The first capsule comprises an aerosol modifying agent. The second capsule comprises an aerosol modifying agent which may be the same or different as the aerosol modifying agent of the first capsule. In some embodiments, a user may selectively rupture the first and second capsules by applying an external force to the aerosol modifying component in order to release the aerosol modifying agent from each capsule.

The aerosol-modifying agent of the second capsule is heated to a lower temperature than the aerosol-modifying agent of the first capsule due to the difference between the first and second temperatures.

The aerosol-modifying agents of the first and second capsules can be selected based on this temperature difference. For instance, the first capsule may comprise a first aerosol modifying agent that has a lower vapor pressure than a second aerosol modifying agent of the second capsule. If the capsules were both heated to the same temperature, then the higher vapor pressure of the aerosol modifying agent of the second capsule would mean that a greater amount of the second aerosol modifying agent would be volatized relative to the aerosol modifying agent of the first capsule. However, since the second capsule is heated to a lower temperature, this effect is less pronounced such that a more even amount of the aerosol modifying agents of the first and second capsules are volatized upon breaking of the first and second capsules respectively.

In some embodiments, the first and second capsules have the same aerosol-modifying profiles, meaning that both capsules contain the same type of aerosol-modifying agent and in the same amount such that if both capsules were heated to the same temperature and broken then both capsules would cause the same modification of the aerosol. However, since the first capsule is heated to a higher temperature than the second capsule, more of the aerosol-modifying agent of the first capsule will be, for example, volatized compared to the modifying agent of the second capsule and thus will cause a more pronounced modification of the aerosol than the second capsule. Therefore, despite both capsules being the same, which may make the aerosol modifying component easier and/or less expensive to manufacture, the user can decide whether to break the first capsule to cause a more pronounced modification of the aerosol, or the second capsule to cause a less pronounced modification of the aerosol, or both capsules to cause the greatest modification of the aerosol.

In some embodiments, the first and second capsules both comprise first and second aerosol modifying agents. The first aerosol modifying agent has a lower vapor pressure than the second aerosol modifying agent. Thus, when the second capsule is broken, a greater proportion of the second aerosol modifying agent will be vaporized relative to the first aerosol modifying agent in comparison to when the hotter first capsule is broken during use of the system to generate aerosol. Therefore, the same capsule can be used to generate different modifications of the aerosol based on the positon of the capsule in the first or second portion of the aerosol modifying component.

Figure 9:
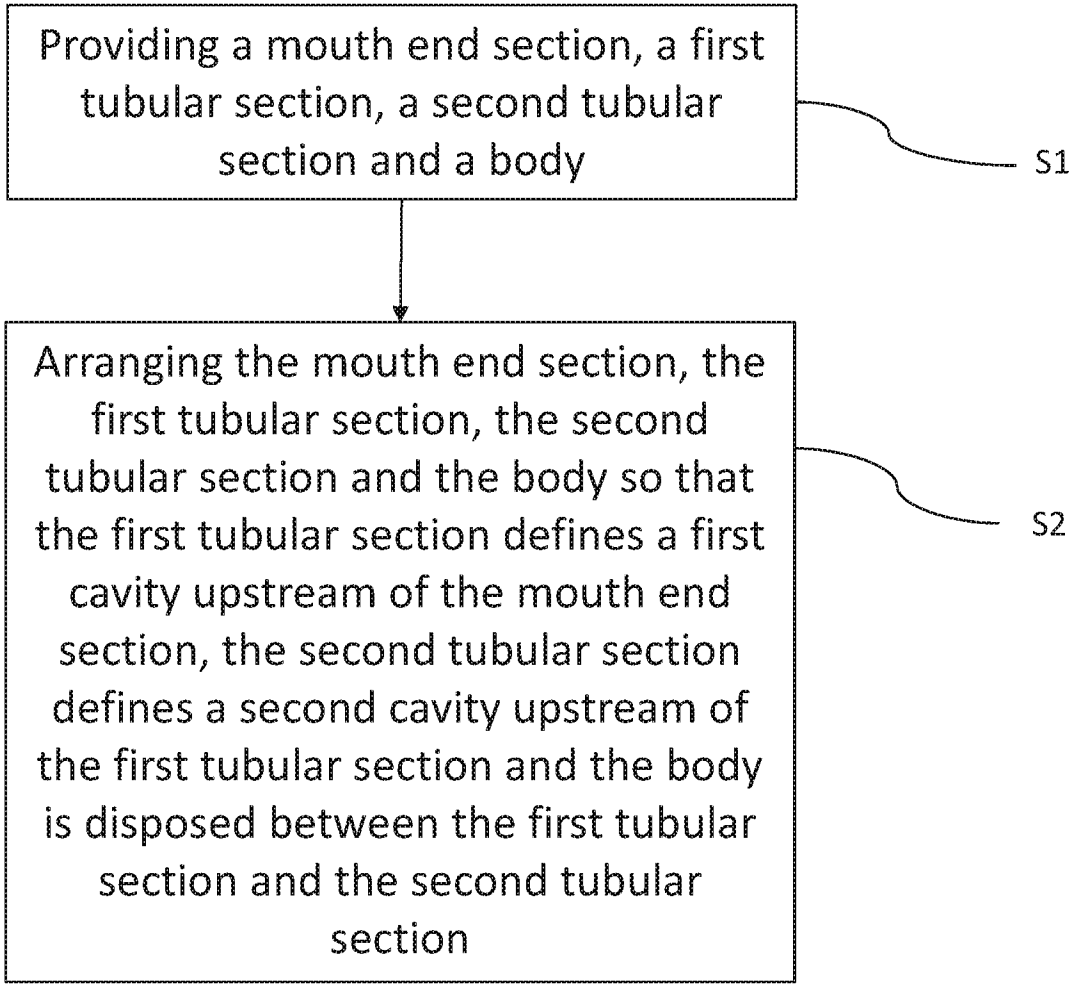
FIG. 9 is a flow diagram illustrating a method of manufacturing a component for an article for use with a non-combustible aerosol provision device.

FIG. 9 is a flow diagram illustrating a method of manufacturing a component for an article for use with a non-combustible aerosol provision device or in a non-combustible aerosol provision system.

At step S1, a mouth end section, a first tubular section, a second tubular section and a body are provided. These components can be formed separately from base rods of the relevant structure, cut into individual components. At step S2, the mouth end section, the first tubular section, the second tubular section and the body are arranged so that the first tubular section defines a first cavity upstream of the mouth end section, the second tubular section defines a second cavity upstream of the first tubular section and the body is disposed between the first tubular section and the second tubular section. For instance, the sections and the body are longitudinally aligned in an array and wrapped in a wrapper, then cut to form the component. As a further step (not shown), a rod of aerosol-generating material can be attached to the mouthpiece to form an article, for instance using tipping paper.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A component for an article for use in a non-combustible aerosol provision system, the component comprising:

a mouth end section;

a first tubular section defining a first cavity upstream of the mouth end section;

a second tubular section defining a second cavity upstream of the first tubular section; and a body disposed between the first tubular section and the second tubular section, wherein the body disposed between the first tubular section and the second tubular section is a continuous body of material, wherein a density of the continuous body of material is less than about 0.75 grams per cubic centimeter (g/cc).

2. A component according to claim 1, wherein at least one of the first tubular section, the second tubular section and the body comprises filamentary tow.

3. A component according to claim 2, wherein the filamentary tow comprises cellulose acetate.

4. A component according to claim 2, wherein the filamentary tow comprises filaments having a cross-section with an isoperimetric ratio of 25 or less.

5. A component according to claim 1, wherein at least one of the first tubular section, the second tubular section and the body comprises paper.

6. A component according to claim 5, wherein said paper has a thickness greater than 325 microns and/or a permeability of at least 100 Coresta Units.

7. A component according to claim 1, wherein the pressure drop across the body disposed between the first tubular section and the second tubular section is at least about 3 mm $H_2O$.

8. A component according to claim 1, wherein the first cavity and/or second cavity has a length of 8 mm or less.

9. A component according to claim 1, wherein the first tubular section and/or the second tubular section has a wall thickness in the range 0.3 mm to 2.5 mm.

10. A component according claim 1, wherein the mouth end section comprises a continuous body of material and/or a tubular body.

11. A component according to claim 10, wherein the mouth end section comprises a length of greater than about 10 mm or greater than about 12 mm.

12. A component according to claim 1, further comprising at least one ventilation area arranged to allow external air to flow into the component.

13. A component according to claim 12, wherein said at least one ventilation area comprises a single row of ventilation apertures.

14. A component according to claim 12, wherein said at least one ventilation area comprises two or more rows of ventilation apertures.

15. A component according to claim 12, wherein the level of ventilation provided by said at least one ventilation area is within the range of 45% to 65% of the volume of aerosol passing through the component.

16. An article for use with a non-combustible aerosol provision device, the article comprising:

an aerosol generating material comprising at least one aerosol forming material; and a component according to claim 1.

17. An article according to claim 16, further comprising a wrapper surrounding said aerosol generating material, wherein the wrapper has a citrate content of 1% by weight or less.

18. A non-combustible aerosol provision system, comprising:

an article according to claim 16; and a non-combustible aerosol provision device for use with the article.

19. A method of manufacturing a component for an article for use in a non-combustible aerosol provision system, the method comprising:

providing a mouth end section, a first tubular section, a second tubular section and a body; and arranging the mouth end section, the first tubular section, the second tubular section and the body so that the first tubular section defines a first cavity upstream of the mouth end section, the second tubular section defines a second cavity upstream of the first tubular section and the body is disposed between the first tubular section and the second tubular section, wherein the body disposed between the first tubular section and the second tubular section is continuous body of material, wherein a density of the continuous body of material is less than about 0.75 grams per cubic centimeter (g/cc).

* * * * *